US010588378B2

(12) United States Patent
Groeneweg et al.

(10) Patent No.: US 10,588,378 B2
(45) Date of Patent: Mar. 17, 2020

(54) ARTICLES OF FOOTWEAR WITH STABILIZING RAILS

(71) Applicant: adidas AG, Herzogenaurach (DE)

(72) Inventors: Nicholas Allen Groeneweg, Portland, OR (US); Matteo Padovani, Portland, OR (US)

(73) Assignee: adidas AG, Herzogenaurach (DE)

( * ) Notice: Subject to any disclaimer, the term of this patent is extended or adjusted under 35 U.S.C. 154(b) by 289 days.

(21) Appl. No.: 15/170,537

(22) Filed: Jun. 1, 2016

(65) Prior Publication Data

US 2017/0347747 A1 Dec. 7, 2017

(51) Int. Cl.

| | |
|---|---|
| ***A43B 7/28*** | (2006.01) |
| ***A43B 7/24*** | (2006.01) |
| ***A43B 7/14*** | (2006.01) |
| ***A43B 23/02*** | (2006.01) |
| ***A43B 13/04*** | (2006.01) |
| ***A43B 13/12*** | (2006.01) |
| ***A43B 13/14*** | (2006.01) |
| ***A43B 13/18*** | (2006.01) |

(52) U.S. Cl.

CPC ..... *A43B 7/28* (2013.01); *A43B 7/1495* (2013.01); *A43B 7/24* (2013.01); *A43B 13/04* (2013.01); *A43B 13/12* (2013.01); *A43B 13/141* (2013.01); *A43B 13/187* (2013.01); *A43B 23/0235* (2013.01); *A43B 23/0275* (2013.01)

(58) Field of Classification Search

CPC ..... A43B 7/28; A43B 7/1495; A43B 7/24; A43B 7/14; A43B 13/04; A43B 13/12; A43B 13/141; A43B 13/187; A43B 13/125; A43B 13/127; A43B 23/0235; A43B 23/0275; A43B 23/0265; A43B 5/003

USPC ..... 36/92, 88, 89, 81, 68, 69

See application file for complete search history.

(56) References Cited

U.S. PATENT DOCUMENTS 5,896,683 A * 4/1999 Foxen ..... A43B 7/20 36/89
6,401,366 B2 * 6/2002 Foxen ..... A43B 7/1495 36/102

(Continued)

FOREIGN PATENT DOCUMENTS

CN 102762121 A 10/2012
CN 203121215 U 8/2013

(Continued)

OTHER PUBLICATIONS

Extended European Search Report issued in European Application No. 17172672.2, dated Oct. 9, 2017, 8 pages.

*Primary Examiner* — Anna K Kinsaul
*Assistant Examiner* — F Griffin Hall
(74) *Attorney, Agent, or Firm* — Sterne, Kessler, Goldstein & Fox P.L.L.C.

(57) ABSTRACT

An article of footwear including an upper, a midsole, a lateral stabilizing rail, and a medial stabilizing rail. The lateral stabilizing rail may be coupled to the upper and the midsole and extend from a forefoot portion of the article of footwear to a heel portion of the article of footwear. The medial stabilizing rail may be coupled to the upper and the midsole and extend from the forefoot portion of the article of footwear to the heel portion of the article of footwear. The lateral stabilizing rail and the medial stabilizing rail may be separate pieces capable deforming independently of each other.

18 Claims, 9 Drawing Sheets

(56) References Cited

U.S. PATENT DOCUMENTS

| | | | | |
|---|---|---|---|---|
| 6,497,058 | B2 * | 12/2002 | Dietrich | A43B 7/24 36/142 |
| 6,973,746 | B2 | 12/2005 | Auger et al. | |
| 7,082,702 | B2 * | 8/2006 | Cretinon | A43B 13/026 36/107 |
| 7,299,567 | B2 * | 11/2007 | Berend | A43B 7/142 36/107 |
| 8,327,560 | B2 * | 12/2012 | Berend | A43B 7/142 36/132 |
| 8,850,721 | B2 * | 10/2014 | Long | A43B 5/12 36/107 |
| 9,241,535 | B2 * | 1/2016 | Baudouin | A43B 13/181 |
| 2002/0007570 | A1 | 1/2002 | Girard | |
| 2008/0244930 | A1 * | 10/2008 | Rivas | A43B 7/24 36/88 |
| 2009/0260259 | A1 | 10/2009 | Berend | |
| 2011/0308115 | A1 | 12/2011 | Le et al. | |
| 2013/0291409 | A1 | 11/2013 | Reinhardt et al. | |
| 2014/0202044 | A1 | 7/2014 | Adami et al. | |

FOREIGN PATENT DOCUMENTS

| | | | |
|---|---|---|---|
| CN | 203388337 | U | 1/2014 |
| CN | 105050441 | A | 11/2015 |
| DE | 10211362 | A1 | 9/2003 |
| EP | 2580976 | A1 | 4/2013 |
| WO | 2006009866 | A1 | 1/2006 |
| WO | 2014152333 | A1 | 9/2014 |

* cited by examiner

ARTICLES OF FOOTWEAR WITH STABILIZING RAILS

FIELD

The described embodiments generally relate to articles of footwear with stabilizing rails. In particular, described embodiments relate to articles of footwear including a pair of stabilizing rails, a lateral stabilizing rail and a medial stabilizing rail, for providing stability and propulsion for an article of footwear

BACKGROUND

Individuals are often concerned with the durability, weight, and/or comfort of an article of footwear. This is true for articles of footwear worn for non-performance activities, such as a leisurely stroll, and for performance activities, such as running. Durable footwear will properly function for an extended period of time. Lightweight footwear minimizes the weight an individual has to carry on his or her feet and may be comfortable for an individual. Customized footwear may increase comfort for an individual because it is tailored to the individual's foot anatomy.

For some individuals, for example athletes, stability and propulsion may be desired characteristics for an article of footwear. Footwear that facilitates propulsion (e.g., forward and/or upward motion) may help an athlete perform at an optimal athletic level. Stability for footwear, an in particular stability in portions supporting the ankles of an individual, may reduce the chance of injury to the individual's feet.

Proper footwear should be durable, comfortable, and provide other beneficial characteristics for an individual. Therefore, a continuing need exists for innovations in footwear.

BRIEF SUMMARY OF THE INVENTION

Some embodiments are directed towards an article of footwear including an upper coupled to a midsole; a lateral stabilizing rail coupled to the upper and the midsole and extending from a forefoot portion of the article of footwear to a heel portion of the article of footwear, the lateral stabilizing rail including a forefoot end coupled to a bottom surface of the midsole and a heel end coupled to and wrapping around at least a portion of a heel end of the upper; and a medial stabilizing rail coupled to the upper and the midsole and extending from the forefoot portion of the article of footwear to the heel portion of the article of footwear, the medial stabilizing rail including a forefoot end coupled to the bottom surface of the midsole and a heel end coupled to and wrapping around at least a portion of the heel end of the upper; where the lateral stabilizing rail and the medial stabilizing rail are separate pieces and the lateral stabilizing rail is a single integrally formed piece and the medial stabilizing rail is a single integrally formed piece.

In some embodiments, the lateral stabilizing rail and the medial stabilizing rail may be independent rails. In some embodiments, the lateral stabilizing rail and the medial stabilizing rail may not be attached to each other.

In some embodiments, the heel end of the lateral stabilizing rail may include a bottom portion coupled to a top surface of the midsole and a top portion coupled to a heel portion of the upper and the heel end of the medial stabilizing rail may include a bottom portion coupled to the top surface of the midsole and a top portion coupled to the heel portion of the upper.

In some embodiments, the article of footwear may include an outsole coupled to the midsole and disposed over the forefoot end of the lateral stabilizing rail and the forefoot end of the medial stabilizing rail.

In some embodiments, the lateral stabilizing rail and the medial stabilizing rail may be composed of a material having a higher stiffness than the material of the midsole.

In some embodiments, the medial stabilizing rail may include ribbing disposed along at least a portion of the medial stabilizing rail and the ribbing of the medial stabilizing rail may include one or more areas of increased thickness to provide increased stiffness. In some embodiments, the ribbing of the medial stabilizing rail may extend from the forefoot portion of the article of footwear to a midfoot portion of the article of footwear.

In some embodiments, the lateral stabilizing rail may include ribbing disposed along at least a portion of the lateral stabilizing rail and the ribbing of the lateral stabilizing rail may include one or more areas of increased thickness to provide increased stiffness. In some embodiments, the ribbing of the lateral stabilizing rail may extend from the forefoot portion of the article of footwear to a midfoot portion of the article of footwear.

In some embodiments, the midsole may include a lateral groove formed in a lateral side surface and the bottom surface of the midsole and a medial groove formed in a medial side surface, the bottom surface of the midsole and the lateral stabilizing rail may be partially disposed in the lateral groove, and the medial stabilizing rail may be partially disposed in the medial groove.

In some embodiments, the upper may include a hollow interior for receiving a wearer's foot, the hollow interior defined by an innermost surface of the upper, and the distance between the innermost surface and the lateral stabilizing rail may decrease from the forefoot end of the lateral stabilizing rail to the heel end of the lateral stabilizing rail and the distance between the innermost surface and the medial stabilizing rail may decrease from the forefoot end of the medial stabilizing rail to the heel end of the medial stabilizing rail.

In some embodiments, the heel end of the lateral stabilizing rail may include a bottom portion coupled to a top surface of the midsole and a top portion coupled to a heel portion of the upper extending towards the forefoot portion of the article of footwear, and the heel end of the medial stabilizing rail may include a bottom portion coupled to the top surface of the midsole and a top portion coupled to the heel portion of the upper and wrapped around at least a portion of the heel end of the upper.

In some embodiments, a portion of the top portion of the lateral stabilizing rail and a portion of the top portion of the medial stabilizing rail may extend in the same direction around the perimeter of the upper.

In some embodiments, the heel end of the lateral stabilizing rail and the heel end of the medial stabilizing rail may have different shapes. In some embodiments, the heel end of the lateral stabilizing rail and the heel end of the medial stabilizing rail may have substantially the same shape. In some embodiments, the lateral stabilizing rail and the medial stabilizing rail may be substantially mirror images of each other.

Some embodiments are directed towards an article of footwear including an upper coupled to a midsole; a lateral stabilizing rail coupled to the upper and the midsole and extending from a forefoot portion of the article of footwear to a heel portion of the article of footwear, the lateral stabilizing rail including a forefoot end coupled to the midsole, a heel end coupled to and wrapping around at least a portion of a heel end of the upper, and a lateral fin extending from the heel end of the lateral stabilizing rail; and a medial stabilizing rail coupled to the upper and the midsole and extending from the forefoot portion of the article of footwear to the heel portion of the article of footwear, the medial stabilizing rail including a forefoot end coupled to the midsole, a heel end coupled to and wrapping around at least a portion of the heel end of the upper, and a medial fin extending from the heel end of the medial stabilizing rail; where the lateral fin and the medial fin extend in the same direction around the perimeter of the upper.

In some embodiments, the lateral fin may extend towards the forefoot portion of the article of footwear and the medial fin may extend towards and wraps around at least a portion of the heel end of the upper.

Some embodiments may be directed towards an article of footwear including an upper coupled to a midsole; a lateral stabilizing rail coupled to the upper and the midsole and extending from a forefoot portion of the article of footwear to a heel portion of the article of footwear, the lateral stabilizing rail including a forefoot end coupled to a bottom surface of the midsole and a heel end coupled to and wrapping around at least a portion of a heel end of the upper; and a medial stabilizing rail coupled to the upper and the midsole and extending from the forefoot portion of the article of footwear to the heel portion of the article of footwear, the medial stabilizing rail including a forefoot end coupled to the bottom surface of the midsole and a heel end coupled to and wrapping around at least a portion of the heel end of the upper; where the heel end of the lateral stabilizing rail includes a bottom portion coupled to a top surface of the midsole and a top portion coupled to a heel portion of the upper and the heel end of the medial stabilizing rail includes a bottom portion coupled to the top surface of the midsole and a top portion coupled to the heel portion of the upper.

BRIEF DESCRIPTION OF THE DRAWINGS/FIGURES

DETAILED DESCRIPTION OF THE INVENTION

Figure 1:
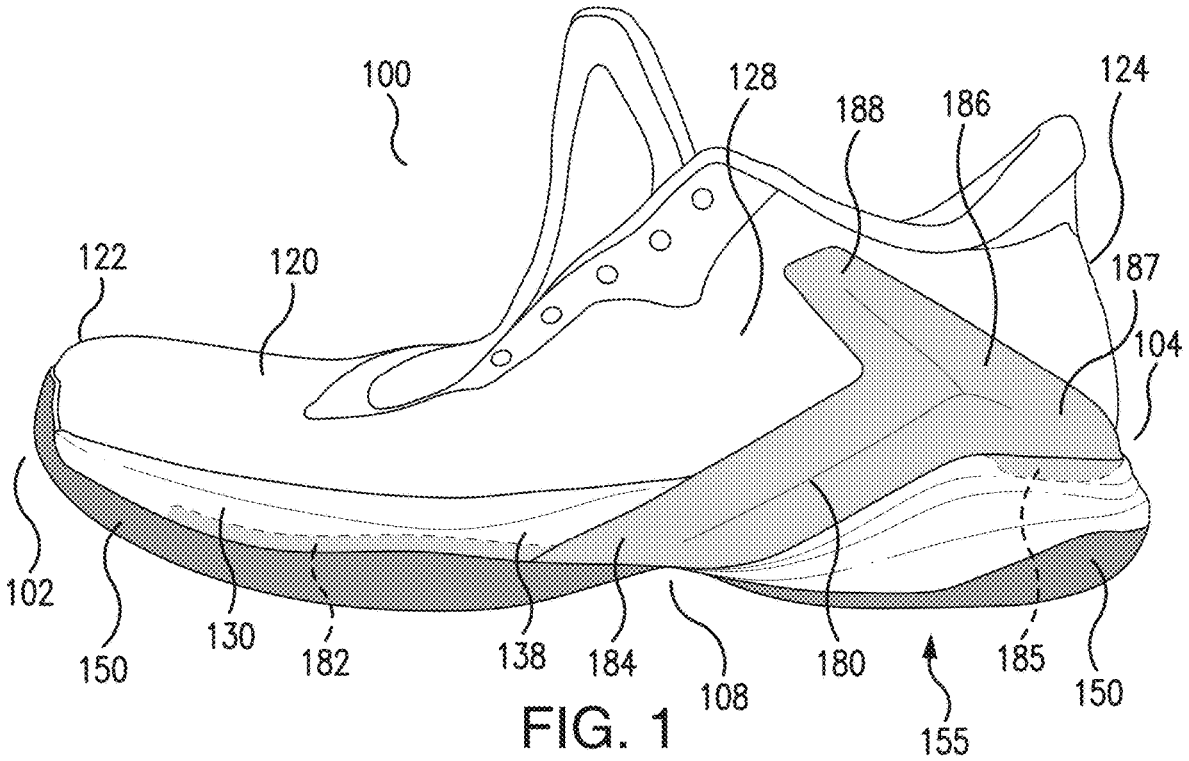
FIG. 1 is a lateral side view of an article of footwear according to an embodiment.
Figure 2:
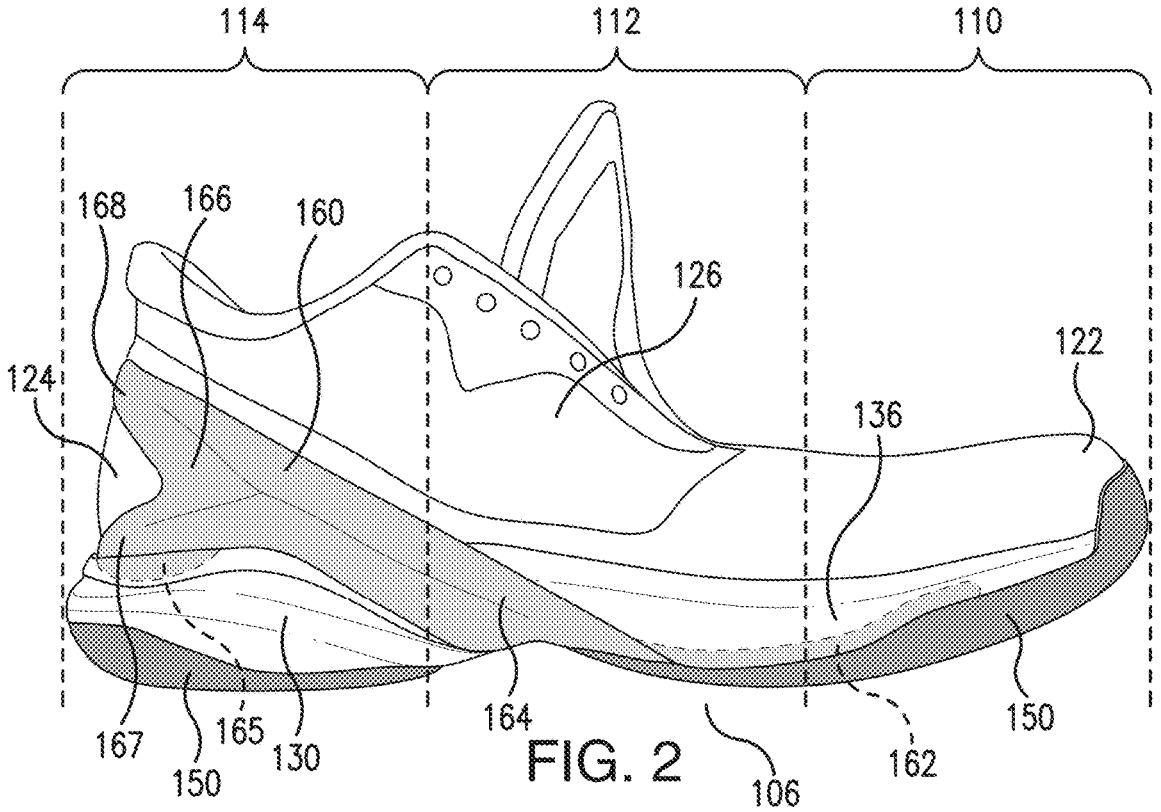
FIG. 2 is a medial side view of an article of footwear according to an embodiment.
Figure 3:
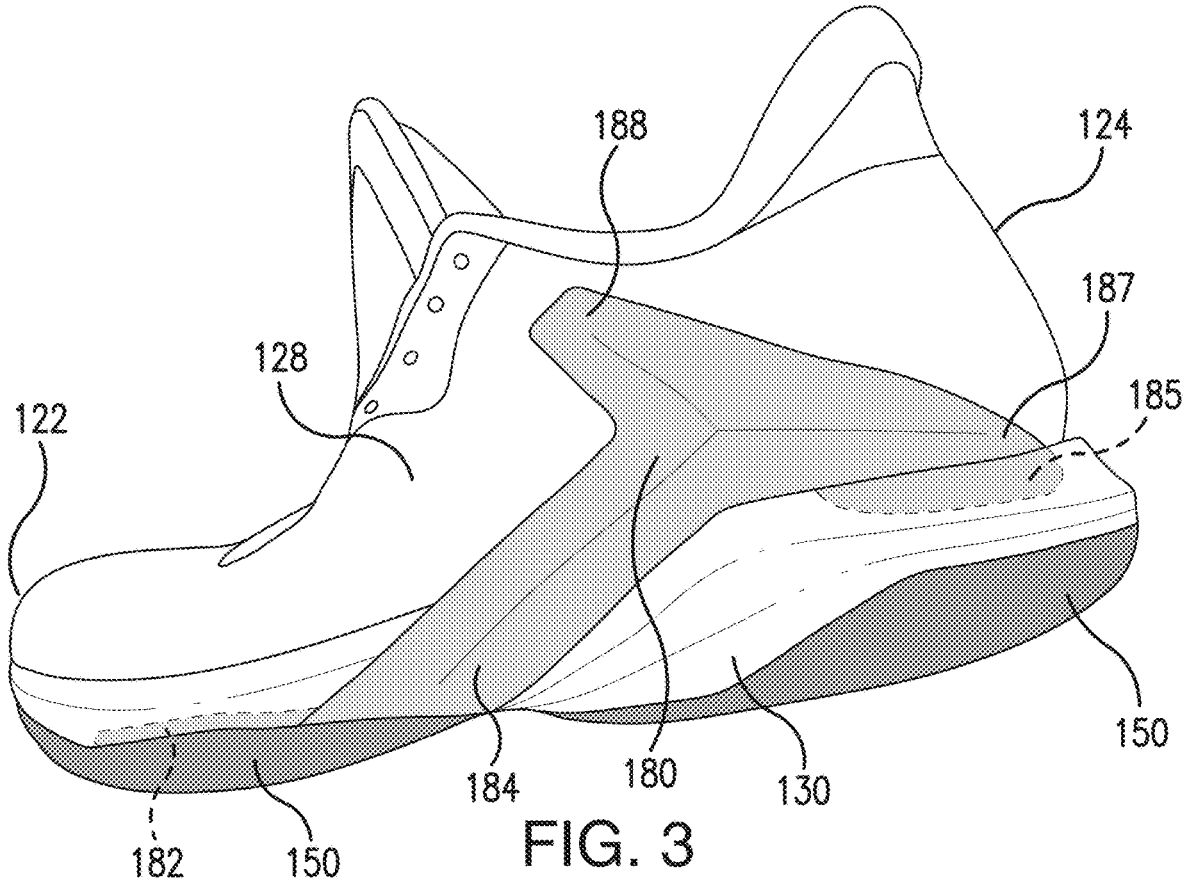
FIG. 3 is a lateral perspective view of an article of footwear according to an embodiment.
Figure 4:
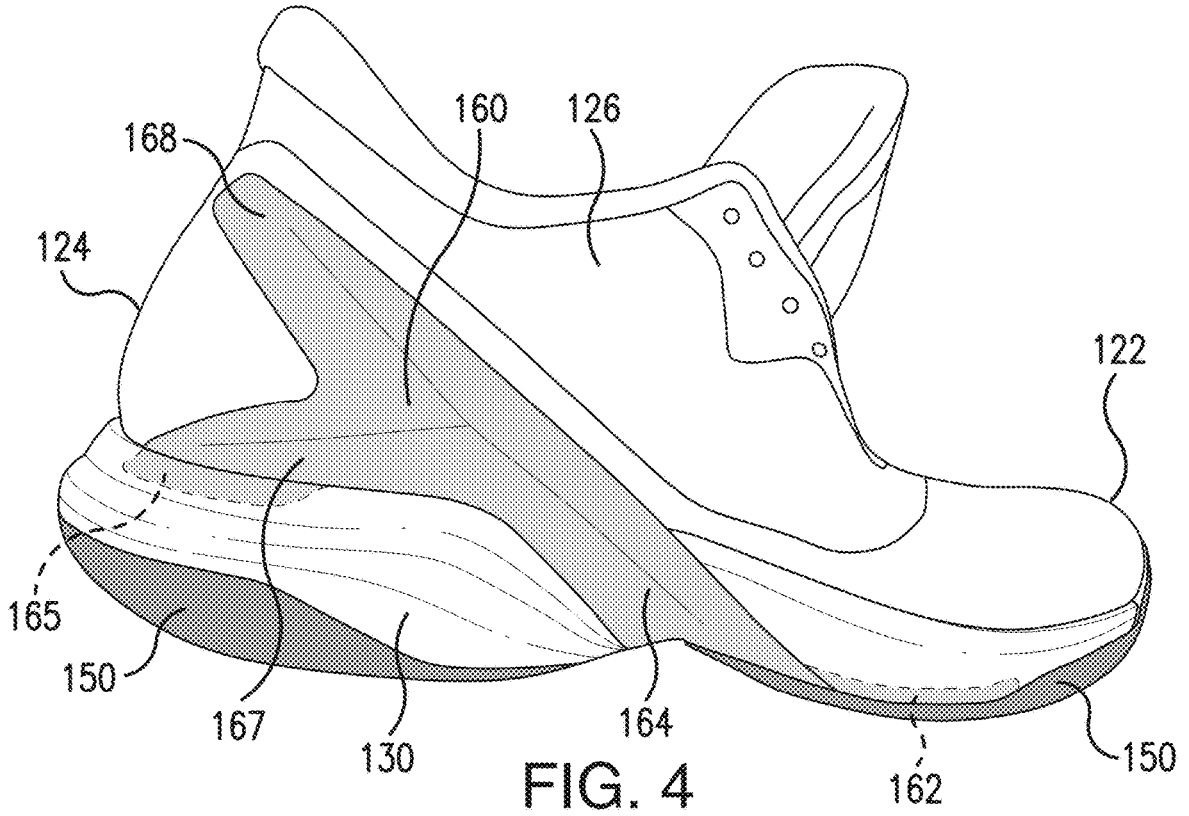
FIG. 4 is a medial perspective view of an article of footwear according to an embodiment.
Figure 5:
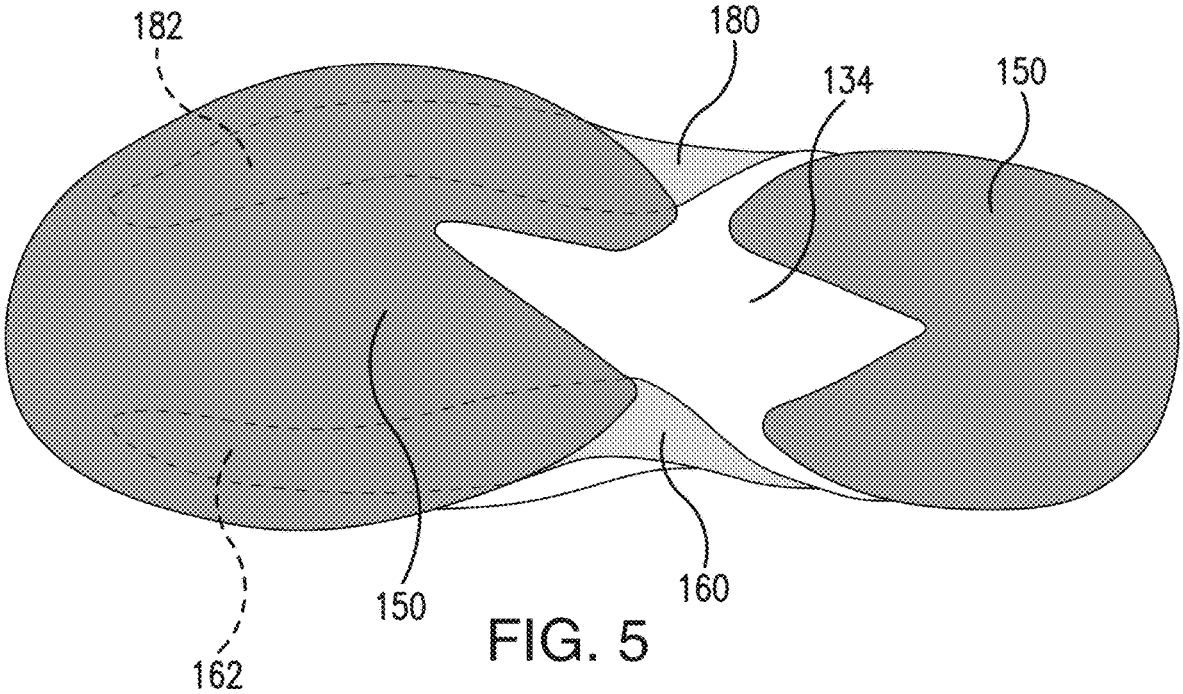
FIG. 5 is a bottom view of an article of footwear according to an embodiment.
Figure 6:
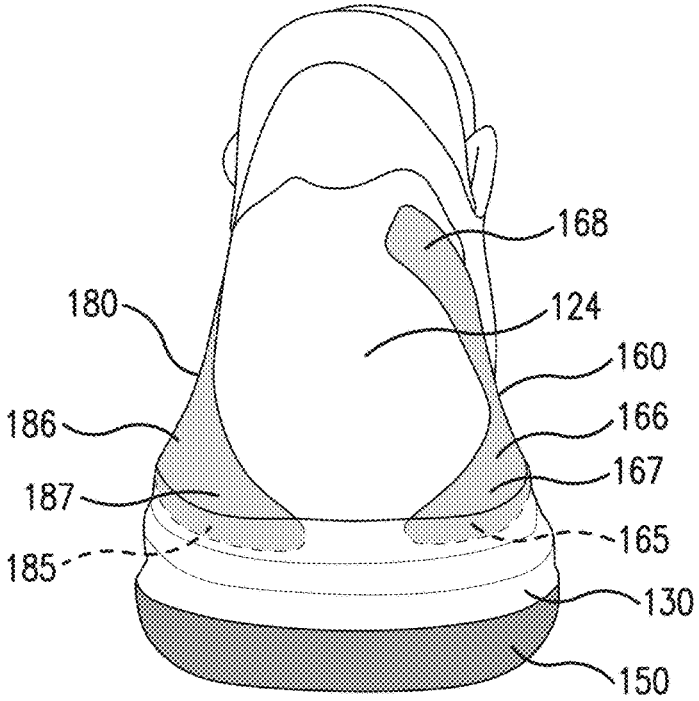
FIG. 6 is a heel end view of an article of footwear according to an embodiment.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

An article of footwear has many purposes. Among other things, an article of footwear may serve to provide cushioning for a wearer's foot, support a wearer's foot, protect a wearer's foot (e.g., from injury), and optimize the performance of a wearer's foot. Each of these purposes, alone or in combination, provides for a comfortable article of footwear suitable for use in a variety of scenarios (e.g., exercise and every day activities). The features of an article of footwear (e.g., shape, components, and materials used to make footwear) may be altered to produce desired characteristics, for example, support, stability, and propulsion characteristics.

Stability provided by an article of footwear may protect a wearer's foot from injury, such as spraining his or her ankle. Propulsion provided by an article of footwear may optimize the performance of a wearer's foot by, for example, maximizing the energy transfer from the individual's foot to the surface his or her foot is in contact with (e.g., the ground), via the article of footwear. Maximizing the energy transfer between the individual's foot and a surface (i.e., reducing energy lost via and/or absorbed by an article of footwear) may help an athlete, for example, accelerate faster, maintain a higher maximum speed, change directions faster, and jump higher.

Some embodiments are directed to articles of footwear including a pair of independent rails for providing stability and propulsion for an article of footwear. The pair of rails may include a lateral rail disposed on the lateral side of the article of footwear and a medial rail disposed on the medial side of the article of footwear. The lateral rail may extend from a forefoot portion of the article of footwear to a heel end of the article of footwear. Similarly, the medial rail may extend from a forefoot portion of the article of footwear to a heel end of the article of footwear. The lateral rail and medial rail may stiffen the article of footwear to provide stability for the article of footwear and prevent undesired twisting or bending of a wearer's foot. The lateral rail and medial rail, and in particular the portions of the lateral rail and the medial rail disposed in the midfoot and forefoot portions of the article of footwear, may control the flexion of the forefoot portion of the article of footwear to provide propulsion (i.e., maximize the energy transfer between the individual's foot and the ground). Further, lateral and medial rails that extend from a forefoot portion of the article of footwear to a heel end of the article of footwear may provide propulsion by transferring energy from the heel end of the article of footwear to the forefoot portion of the article of footwear.

The independent nature of the lateral and medial rails discussed herein may provide stability and propulsion for an article of footwear without sacrificing mobility and/or comfort for a wearer. The independent nature of the lateral and medial rails allows the rails to deform independently of each other. This allows the rails to move independently of each other when a wearer moves (e.g., changes direction), which avoids unduly limiting the range of motion for a wearer's foot and/or causing discomfort for a wearer. As used herein the term "independent rails" means two or more rails that are not attached to each other, either directly or via a connector, and that are capable of deforming completely independent of each other. Independent rails may be coupled to the same midsole, upper, and/or outsole, however, such coupling is the only connection between two independent rails.

In some embodiments, the lateral and medial rails and/or the material of a midsole to which the lateral and medial rails are coupled may be tailored to produce desired characteristics (e.g., support, stability, mobility, and propulsion). For example, a basketball or football player may desire a relatively large amount of ankle support and stability to protect his or her ankles when changing direction at high speed or colliding with other players. In such a case, the lateral and/or medial rails may include heel ends that extend over, and in some embodiments, above the wearer's lateral malleolus and/or medial malleolus to provide increased ankle support and the midsole may be composed of a relatively stiff material. As another example, a track runner or jogger may desire a relatively small amount of ankle support, but would prefer an article of footwear that is lightweight, and with a midsole that provides a large amount of cushion for long workouts. In such a case, the lateral and medial rails may include heel ends that do not extend over or above the wearer's medial malleolus and lateral malleolus and the midsole may be composed of a relatively soft material. The independent nature of the lateral and medial rails facilitates these and similar customizations of an article of footwear for a particular individual's needs.

FIGS. 1-6 show an article of footwear 100 according to an embodiment. Article of footwear 100 may include an upper 120 coupled to a midsole 130. Article of footwear 100 includes a forefoot end 102, a heel end 104, a medial side 106, and a lateral side 108 opposite medial side 106. Also, as shown for example in FIG. 2, article of footwear 100 includes a forefoot portion 110, a midfoot portion 112, and a heel portion 114. Portions 110, 112, and 114 are not intended to demarcate precise areas of article of footwear 100. Rather, portions 110, 112, and 114 are intended to represent general areas of article of footwear 100 that provide a frame of reference. Although portions 110, 112, and 114 apply generally to article of footwear 100, references to portions 110, 112, and 114 also may apply specifically to upper 120 or midsole 130, or individual components of upper 120 or midsole 130. In some embodiments, article of footwear 100 may include an outsole 150 coupled to midsole 130. Together, midsole 130 and outsole 150 may define a sole 155 of article of footwear 100. The portions of FIGS. 1-6 shown in broken lines are for illustration purposes. These portions would be concealed from view when looking at the embodiment shown in FIGS. 1-6.

Article of footwear 100 may include a lateral stabilizing rail 180 coupled to upper 120 and midsole 130 and extending from forefoot portion 110 of article of footwear 100 to heel portion 114 of article of footwear 100. Lateral stabilizing rail 180 may include a forefoot end 182, a midfoot portion 184, and a heel end 186. In some embodiments, forefoot end 182 may be coupled to a bottom surface 134 of midsole 130 (see bottom surface 134 in FIG. 5) in forefoot portion 110 of midsole 130. Forefoot end 182 may control the flexion of midsole 130 in forefoot portion 110 of midsole 130. In some embodiments, forefoot end 182 of lateral stabilizing rail 180 may extend to a location on article of footwear 100 below a wearer's posterior phalanges. In some embodiments, outsole 150 may be disposed over all or a portion of forefoot end 182 of lateral stabilizing rail 180.

In some embodiments, heel end 186 of lateral stabilizing rail 180 may be coupled to a lateral side 128 of upper 120 and wrap around at least a portion of heel end 124 of upper 120. In some embodiments, a portion of heel end 186 may be coupled to a lateral side surface 138 of midsole 130 in heel portion 114 of midsole 130. Midfoot portion 184 of lateral stabilizing rail 180 may be coupled to lateral side surface 138 of midsole 130 in midfoot portion 112 of midsole 130. Midfoot portion 184 may include a curved segment that warps around lateral side surface 138 to bottom surface 134 of midsole 130. In some embodiments, the curved segment may be located on article of footwear 100 at a location that corresponds to the arch of a wearer's foot.

Article of footwear 100 may include a medial stabilizing rail 160 coupled to upper 120 and midsole 130 and extending from forefoot portion 110 of article of footwear 100 to heel portion 114 of article of footwear 100. Medial stabilizing rail 160 may include a forefoot end 162, a midfoot portion 164, and a heel end 166. In some embodiments, forefoot end 162 may be coupled to bottom surface 134 of midsole 130 (see bottom surface 134 in FIG. 5) in forefoot portion 110 of midsole 130. Forefoot end 162 may control the flexion of midsole 130 in forefoot portion 110 of midsole 130. In some embodiments forefoot end 162 of medial stabilizing rail 160 may extend to a location on article of footwear 100 below a wearer's posterior phalanges. In some embodiments, outsole 150 may be disposed over all or a portion of forefoot end 162 of medial stabilizing rail 160.

In some embodiments, heel end 166 of medial stabilizing rail 160 may be coupled to a medial side 126 of upper 120 and wrap around at least a portion of heel end 124 of upper 120. In some embodiments, a portion of heel end 166 may be coupled to a medial side surface 136 of midsole 130 in heel portion 114 of midsole 130. Midfoot portion 164 of medial stabilizing rail 160 may be coupled to medial side surface 136 of midsole 130 in midfoot portion 112 of midsole 130. Midfoot portion 164 may include a curved segment that warps around medial side surface 136 to bottom surface 134 of midsole 130. In some embodiments, the curved segment may be located on article of footwear 100 at a location that corresponds to the arch of a wearer's foot.

As shown for example, in FIGS. 1-6, lateral stabilizing rail 180 and medial stabilizing rail 160 are separate pieces. In some embodiments, lateral stabilizing rail 180 may be a single integrally formed piece (e.g., an injection molded or three-dimensionally printed piece). In some embodiments, medial stabilizing rail 160 may be a single integrally formed piece (e.g., an injection molded or three-dimensionally printed piece). In some embodiments, lateral stabilizing rail 180 and medial stabilizing rail 160 may not be attached to each other. In some embodiments, lateral stabilizing rail 180 and medial stabilizing rail 160 may be independent rails.

Heel end 186 of lateral stabilizing rail 180 may include a bottom portion 185 coupled to a top surface 132 of midsole (see top surface 132 in FIGS. 7 and 8) and a top portion 187 coupled to heel portion 114 of upper 120. In some embodiments, a portion of top portion 187 may wrap around and be coupled to at least a portion of heel end 124 of upper 120. In some embodiments, a portion of top portion 187 may extend towards forefoot portion 110 of article of footwear 100. Heel end 166 of medial stabilizing rail 160 may include a bottom portion 165 coupled to top surface 132 of midsole 130 and a top portion 167 coupled to heel portion 114 of upper 120. In some embodiments, a portion of top portion 167 may wrap around and be coupled to at least a portion of heel end 124 of upper 120.

In some embodiments, heel end 186 of lateral stabilizing rail 180 and heel end 166 of medial stabilizing rail 160 may have different shapes. In some embodiments, a portion of top portion 187 of lateral stabilizing rail 180 and a portion of top portion 167 of medial stabilizing rail 160 may extend in the same direction around the perimeter of upper 120. In some embodiments, heel end 186 of lateral stabilizing rail 180 and heel end 166 of medial stabilizing rail 160 may have substantially the same shape. In some embodiments, lateral stabilizing rail 180 and medial stabilizing rail 160 may be the same as or similar to lateral stabilizing rail 1050 and medial stabilizing rail 1010 discussed in regards to FIGS. 10-12.

In operation, lateral stabilizing rail 180 and medial stabilizing rail 160 may serve to, among other things, provide stability and propulsion for article of footwear 100. The coupling of lateral stabilizing rail 180 to heel portion 114 and forefoot portion 110 of midsole 130 allows lateral stabilizing rail 180 to control the flexion of midsole 130 along the length of article of footwear 100 (i.e., in the longitudinal direction between forefoot end 102 and heel end 104 of article of footwear 100). Similarly, the coupling of medial stabilizing rail 160 to heel portion 114 and forefoot portion 110 of midsole 130 allows medial stabilizing rail 160 to control the flexion of midsole 130 along the length of article of footwear 100. Controlling the flexion of midsole 130 along the length of article of footwear 100 aids in maximizing energy transfer from a wearer's foot, through article of footwear 100, and to a surface (e.g., the ground). Further, the coupling of lateral stabilizing rail 180 and/or medial stabilizing rail 160 to heel end 124 of upper 120 and to forefoot portion 110 of midsole 130 aids in maximizing energy transfer from heel end 104 of article of footwear 100 to forefoot portion 110 of article of footwear. This aids in maximizing energy transfer from a wearer's foot, through article of footwear 100, to the surface in which the wearer's foot is in contact.

While medial stabilizing rail 160 and lateral stabilizing rail 180 provide stability and maximize energy transfer, the independent nature of rails 160/180 provides comfort and mobility for a wearer. Since rails 160/180 can deform independently of each other, article of footwear 100 may not unduly limit mobility for a wearer's foot. Not unduly limiting the mobility of a wearer's foot may allow a wearer to manipulate his or her foot as desired, for example when changing directions or preparing to land from an airborne position. The mobility provided by the independent rails may reduce the chance of injury to a wearer's foot due to an awkward change in direction or awkward landing.

As shown in FIGS. 1-6, in some embodiments, lateral stabilizing rail 180 may include a lateral fin 188 extending from heel end 186 for providing support and stability for a wearer's ankle. Similarly, medial stabilizing rail 160 may include a medial fin 168 extending from heel end 166 for providing support and stability for a wearer's ankle. In some embodiments, fins 188 and 168 may be integrally formed with heel ends 186 and 166, respectively.

In some embodiments, lateral fin 188 may extend from heel end 186 towards forefoot portion 110 of article of footwear 100 (i.e., towards a toe end 122 of upper 120). In such embodiments, lateral fin 188 may be located in a position on article of footwear 100 that overlaps and/or extends above a wearer's lateral malleolus. The size and shape of lateral fin 188 may be tailored to provide a desired amount of stability and support for the lateral side of a wearer's ankle. In some embodiments, lateral fin 188 may alternatively or additionally extend from heel end 186 towards heel end 124 of upper 120 and wrap around at least a portion of heel end 124 of upper 120.

In some embodiments, medial fin 168 may extend from heel end 166 towards heel end 124 of upper 120 and wrap around at least a portion of heel end 124 of upper 120. The size and shape of medial fin 168 may be tailored to provide a desired amount of stability and support for the medial side of a wearer's ankle. In some embodiments, medial fin 168 may alternatively or additionally extend from heel end 166 towards forefoot portion 110 of article of footwear 100 (i.e., towards toe end 122 of upper 120). In such embodiments, medial fin 168 may include a portion located in a position on article of footwear 100 that overlaps and/or extends above a wearer's lateral malleolus.

In some embodiments, lateral fin 188 and medial fin 168 may extend, or include portions that extend, in the same direction around the perimeter of upper 120 (e.g., counterclockwise as shown in FIGS. 1-6). In some embodiments, lateral fin 188 and medial fin 168 may extend, or include portions that extend, in the opposite directions around the perimeter of upper 120.

In some embodiments, lateral fin 188 and top portion 187 may define a V-shaped heel end 186 for lateral stabilizing rail 180. In some embodiments, the V-shape may open towards forefoot portion 110 of article of footwear 100. In some embodiments, the V-shape may open towards and wrap around at least a portion of heel end 124 of upper 120. In some embodiments, medial fin 168 and top portion 167 may define a V-shaped heel end 166 for medial stabilizing rail 160. In some embodiments, the V-shape may open towards and wrap around at least a portion of heel end 124 of upper 120. In some embodiments, the V-shape may open towards forefoot portion 110 of article of footwear 100.

Upper 120, sole 155, and stabilizing rails 160/180 may be configured for a specific type of footwear, including, but not limited to, a running shoe, a hiking shoe, a water shoe, a training shoe, a fitness shoe, a dancing shoe, a biking shoe, a tennis shoe, a cleat (e.g., a baseball cleat, a soccer cleat, or a football cleat), a basketball shoe, a boot, a walking shoe, a casual shoe, or a dress shoe. Moreover, sole 155 may be sized and shaped to provide a desired combination of cushioning, stability, propulsion, and ride characteristics to article of footwear 100. The term "ride" may be used herein in describing some embodiments as an indication of the sense of smoothness or flow occurring during a gait cycle including heel strike, midfoot stance, toe off, and the transitions between these stages. In some embodiments, sole 155 may provide particular ride features including, but not limited to, appropriate control of pronation and supination, support of natural movement, support of unconstrained or less constrained movement, appropriate management of rates of change and transition, and combinations thereof.

Sole 155 and portions thereof (e.g., midsole 130 and outsole 150) may comprise material(s) for providing desired cushioning, ride, propulsion, and stability. Suitable materials for sole 155 (e.g., midsole 130 and/or outsole 150) include, but are not limited to, a foam, a rubber, ethyl vinyl acetate (EVA), expanded thermoplastic polyurethane (eTPU), expanded polyether block Amide (ePEBA), thermoplastic rubber (TPR) and a thermoplastic polyurethane (PU). In some embodiments, the foam may comprise, for example, an EVA based foam or a PU based foam and the foam may be an open-cell foam or a closed-cell foam. In some embodiments, midsole 130 and/or outsole 150 may comprise elastomers, thermoplastic elastomers (TPE), foam-like plastics, gel-like plastics, and combinations thereof.

In some embodiments, portions of sole 155 (e.g., midsole 130 and outsole 150) may comprise different materials to provide different characteristics to different portions of sole 155. In some embodiments, midsole 130 and outsole 150 may have different hardness characteristics. In some embodiments, the material density of midsole 130 and outsole 150 may be different. In some embodiments, the moduli of the materials used to make midsole 130 and outsole 150 may be different. As a non-limiting example, the material of outsole 150 may have a higher modulus than the material of midsole 130.

Sole 155 and portions thereof (e.g., midsole 130 and outsole 150) may be formed using suitable techniques, including, but not limited to, injection molding, blow molding, compression molding, and rotational molding. In some embodiments, midsole 130 and outsole 150 may be discrete components that are formed separately and attached. In some embodiments, midsole 130 may be attached to outsole 150 via, for example, but not limited to, adhesive bonding, stitching, welding, or a combination thereof. In some embodiments, midsole 130 may be attached to outsole 150 via an adhesive disposed between midsole 130 and outsole 150. In some embodiments, midsole 130 and outsole 150 may be formed as a single piece (e.g., via injection molding). In such embodiments, midsole 130 and outsole 150 may be a single integrally formed piece. In some embodiments, midsole 130 and outsole 150 may be molded around lateral stabilizing rail 180 and medial stabilizing rail 160.

Stabilizing rails 160/180 may be comprise material(s) for providing, among other things, desired support, ride, propulsion, and stability. Suitable materials for stabilizing rails 160/180 may include, but are not limited to, nylon 11, nylon 12, glass-reinforced nylon 11, glass-reinforced nylon 12, or thermoplastic elastomers. In some embodiments, medial stabilizing rail 160 and lateral stabilizing rail 180 may be composed of the same material(s). In some embodiments, medial stabilizing rail 160 and lateral stabilizing rail 180 may be composed of different material(s), or of the same material(s) but with different mechanical properties. In some embodiments, medial stabilizing rail 160 and/or lateral stabilizing rail 180 may be composed of a material having a higher stiffness than the material of midsole 130 and/or outsole 150.

Stabilizing rails 160/180 may be formed using suitable techniques, including, but not limited to, injection molding, compression molding, and three-dimensional printing. Stabilizing rails 160/180 may be attached to upper 120, midsole 130, and/or outsole 150 via for example, but not limited to, adhesive bonding, stitching, welding, or a combination thereof.

In some embodiments, lateral stabilizing rail 180 may include ribbing for increasing the stiffness of one or more portions of lateral stabilizing rail 180. In some embodiments, medial stabilizing rail 160 may include ribbing for increasing the stiffness of one or more portions of medial stabilizing rail. In some embodiments, ribbing for medial stabilizing rail 160 and ribbing for lateral stabilizing rail 180 may be different to provide different degrees of stability and/or propulsion to lateral and medial portions of article of footwear 100. In some embodiments, the thickness of medial stabilizing rail 160 itself, and portions thereof, may be tailored to provide different degrees of stability and/or propulsion to medial portions of article of footwear 100. In some embodiments, the thickness of lateral stabilizing rail 180 itself, and portions thereof, may be tailored to provide different degrees of stability and/or propulsion to lateral portions of article of footwear 100.

Figure 7:
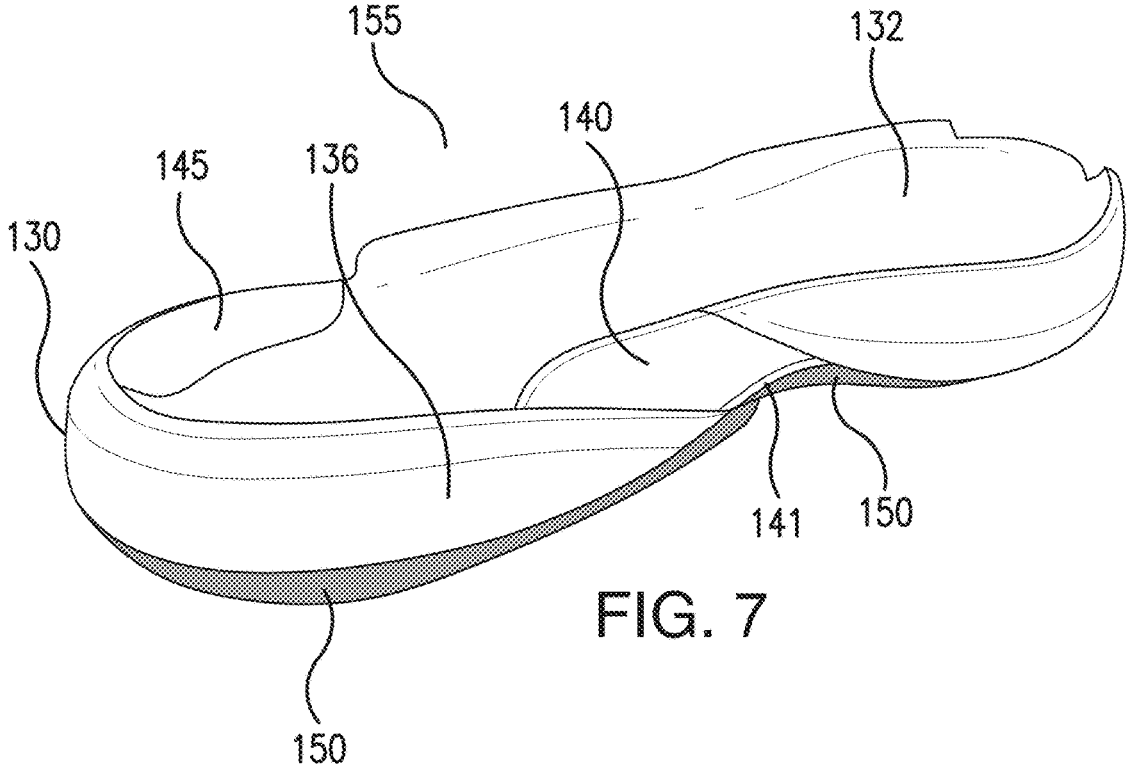
FIG. 7 is a medial perspective view of a sole according to an embodiment.
Figure 8:
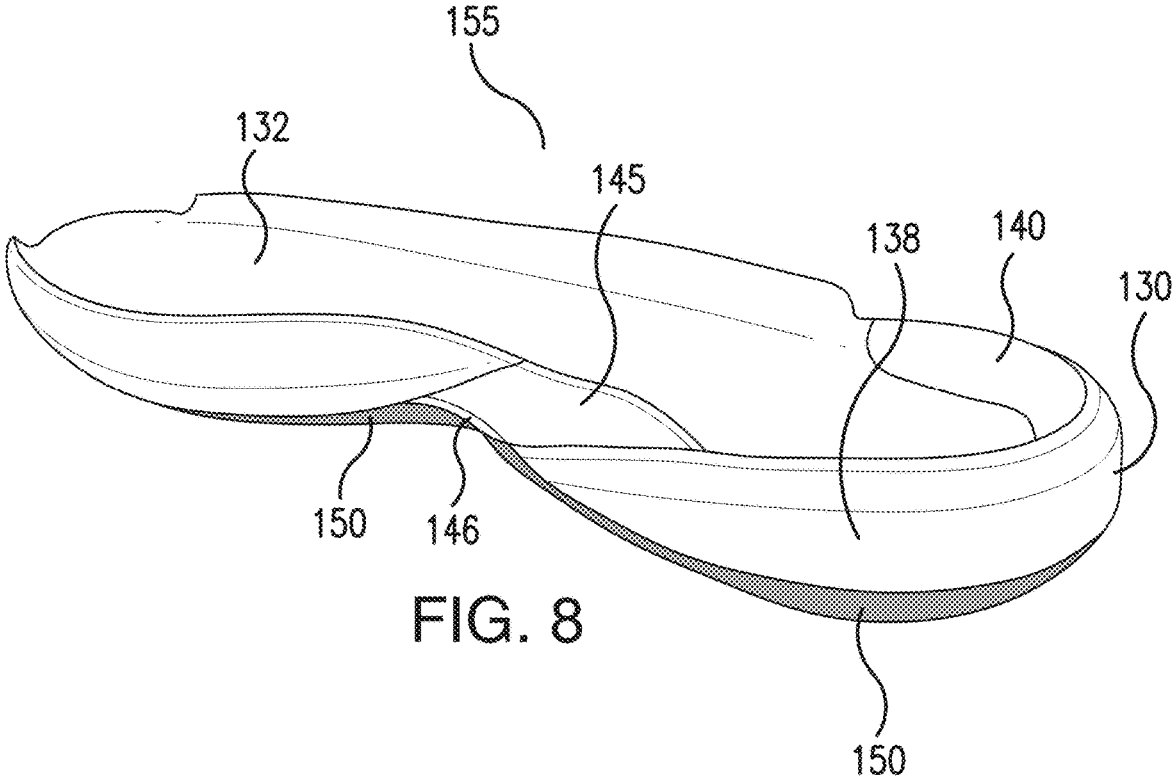
FIG. 8 is a lateral perspective view of a sole according to an embodiment.

FIGS. 7 and 8 show a sole 155 for article of footwear 100 according to an embodiment. In some embodiments, midsole 130 may include a lateral groove 145 formed in lateral side surface 138, top surface 132, and bottom surface 134 of midsole 130. In some embodiments, lateral groove 145 may include one or more recesses configured to receive ribbing on a lateral stabilizing rail (e.g., like recess 952 of lateral groove 950 discussed in regarding to FIG. 9). In some embodiments, outsole 150 and lateral groove 145 may define a slot 146 configured to receive a portion of lateral stabilizing rail 180.

In some embodiments, midsole 130 may include a medial groove 140 formed in a medial side surface 136, top surface 132, and bottom surface 134 of midsole 130. In some embodiments, medial groove 140 may include one or more recesses configured to receive ribbing on a medial stabilizing rail (e.g., like recess 942 of medial groove 940 discussed in regards to FIG. 9). In some embodiments, outsole 150 and medial groove 140 may define a slot 141 configured to receive a portion of medial stabilizing rail 160. Lateral groove 145 and medial groove 140 may facilitate attachment between rails 160/180 and midsole 130 and may help prevent decoupling of rails 160/180 from midsole 130.

Figure 9:
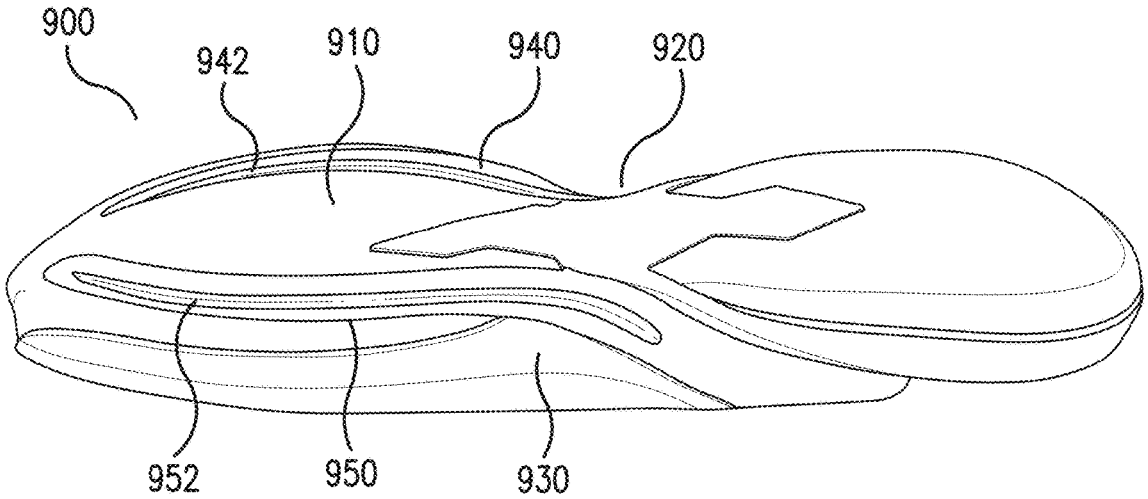
FIG. 9 is a midsole according to an embodiment.

FIG. 9 shows a midsole 900 according to an embodiment. In some embodiments, midsole 900 may include a lateral groove 950 formed in a lateral side surface 930 and a bottom surface 910 of midsole 900 and a medial groove 940 formed in a medial side surface 920 and bottom surface 910 the midsole 900. Lateral groove 950 may be sided and shaped (configured) to receive a portion of a lateral stabilizing rail (e.g., lateral stabilizing rail 180). In such embodiments, the lateral stabilizing rail may be partially disposed in lateral groove 950 when midsole 900 and the lateral stabilizing rail are assembled. Similarly, medial groove 940 may be sized and shaped (configured) to receive a portion of a medial stabilizing rail (e.g., medial stabilizing rail 160). In such embodiments, the medial stabilizing rail may be partially disposed in medial groove 940 when midsole 900 and the medial stabilizing rail are assembled.

In some embodiments, lateral groove 950 may include a recess 952 configured to receive all or a portion of ribbing on a lateral stabilizing rail (see, e.g., ribbing 1080 on lateral stabilizing rail 1050). Similarly, in some embodiments, medial groove 940 may include a recess 942 configured to receive all or a portion of ribbing on a medial stabilizing rail (see, e.g., ribbing 1040 on medial stabilizing rail 1010).

Figure 10:
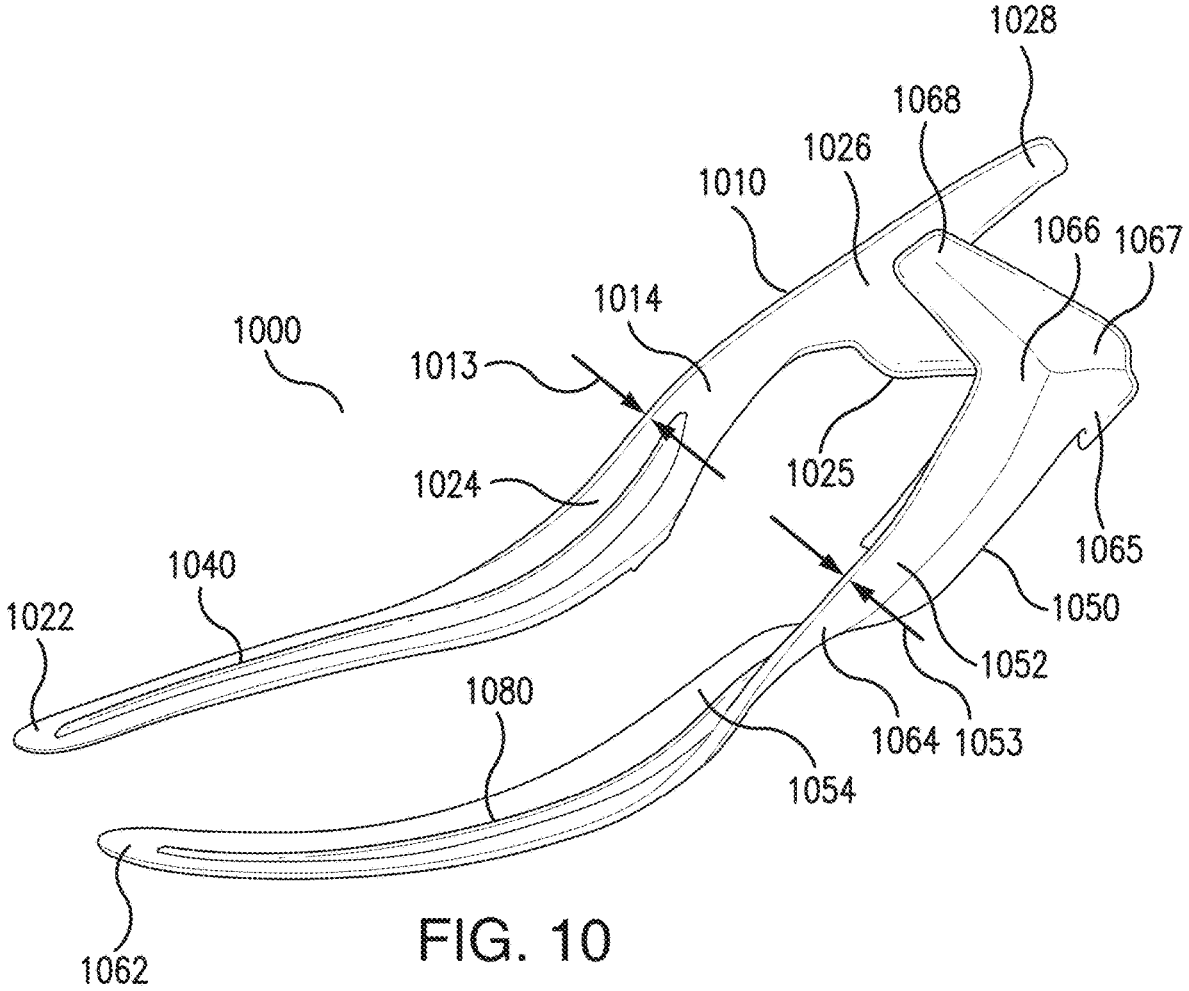
FIG. 10 is a perspective view of a pair of rails according to an embodiment.
Figure 11:
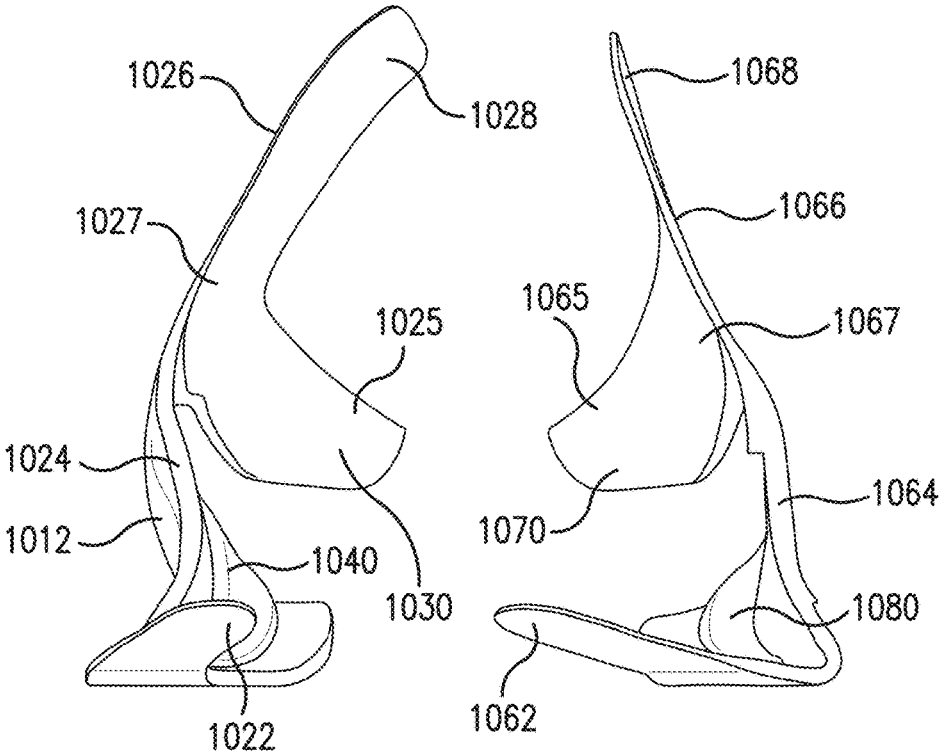
FIG. 11 is a forefoot end view of a pair of rails according to an embodiment.
Figure 12:
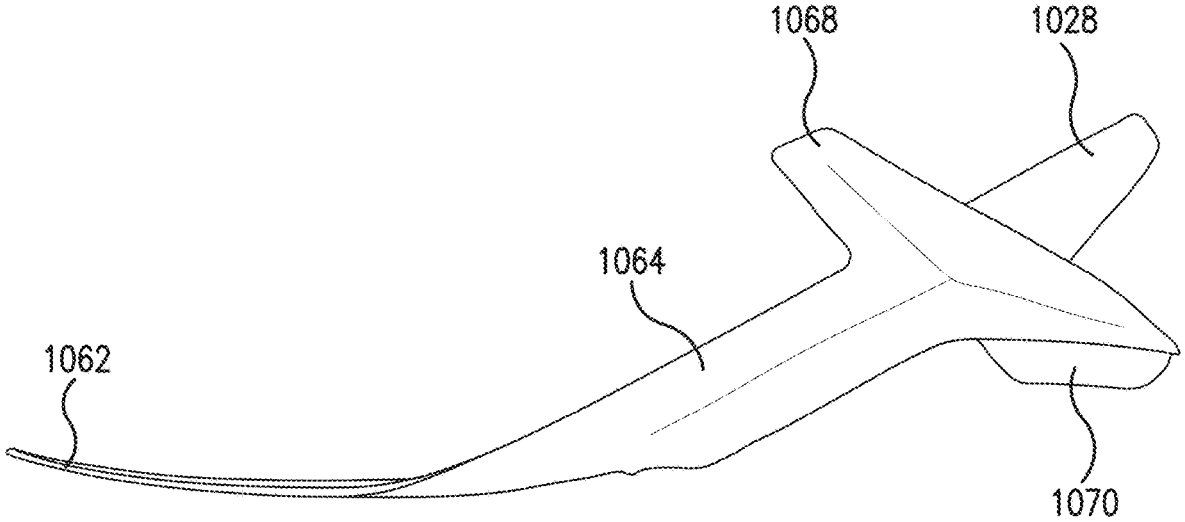
FIG. 12 is a lateral side view of a pair of rails according to an embodiment.

FIGS. 10-12 show a pair of stabilizing rails 1000, lateral stabilizing rail 1050 and medial stabilizing rail 1010, according to an embodiment. Stabilizing rails 1000 may be disposed on an article of footwear, such as for example, article of footwear 100 discussed herein.

Lateral stabilizing rail 1050 includes an exterior surface 1052, an interior surface 1054, and a thickness 1053 defined by exterior surface 1052 and interior surface 1054. In some embodiments, thickness 1053 may be in the range of 1.0 mm and 10.0 mm. When coupled to an article of footwear, interior surface 1054 may be coupled to an upper and midsole as discussed, for example, in regards to lateral stabilizing rail 180 and article of footwear 100. Lateral stabilizing rail 1050 also includes a forefoot end 1062, a midfoot portion 1064, and a heel end 1066.

In some embodiments, lateral stabilizing rail 1050 may include ribbing 1080 for increasing the stiffness of one or more portions of lateral stabilizing rail 1050. Ribbing 1080 may include one or more areas of increased thickness to provide increased stiffness to one or more portions of lateral stabilizing rail 1050. In some embodiments, the thickness of ribbing 1080 may vary along the length of lateral stabilizing rail 1050 to provide varying degrees of stiffness to one or more portions of lateral stabilizing rail 1050. In some embodiments, ribbing 1080 may be disposed on interior surface 1054 of lateral stabilizing rail 1050. In some embodiments, ribbing 1080 may alternatively or additionally be disposed on exterior surface 1052 of lateral stabilizing rail 1050.

In some embodiments, ribbing 1080 may extend from forefoot end 1062 of lateral stabilizing rail 1050 to midfoot portion 1564 of lateral stabilizing rail 1050. In some embodiments, ribbing 1080 may extend from forefoot end 1062 of lateral stabilizing rail 1050 to heel end 1066 of lateral stabilizing rail 1050. The length and position of ribbing(s) 1080 may be tailored to provide desired stiffness characteristics for lateral stabilizing rail 1080.

In some embodiments, lateral stabilizing rail 1050 may include a lateral fin 1068 extending from a top portion 1067 of heel end 1066. Lateral fin 1068 may provide support for the lateral side of a wearer's ankle. The support provided by lateral fin 1068 may help avoid undue twisting of a wearer's ankle. The shape and size of lateral fin 1068 may be tailored to provide a desired amount of support and stability for a wearer's ankle. In some embodiments, ribbing 1080 may be disposed on lateral fin 1068 to provide desired support and stability.

In some embodiments, a bottom portion 1065 of heel end 1066 may include a heel cup 1070. Exterior surface 1052 defining heel cup 1070 may be coupled to a top surface of a midsole (e.g., top surface 132 of midsole 130) when lateral stabilizing rail 1050 is coupled to an article of footwear. Heel cup 1070 may have a shape corresponding to the lateral shape of a wearer's heel for providing support around the wearer's heel. The support provided by heel cup 1070 may help transfer energy from a wearer's foot to the ground (i.e., help provide propulsion).

Medial stabilizing rail 1010 includes an exterior surface 1012, an interior surface 1014, and a thickness 1013 defined by exterior surface 1012 and interior surface 1014. In some embodiments, thickness 1013 may be in the range of 1.0 mm and 10.0 mm. When coupled to an article of footwear, interior surface 1014 may be coupled to an upper and midsole as discussed, for example, in regards to medial stabilizing rail 160 and article of footwear 100. Medial stabilizing rail 1010 also includes a forefoot end 1022, a midfoot portion 1024, and a heel end 1026.

In some embodiments, medial stabilizing rail 1010 may include ribbing 1040 for increasing the stiffness of one or more portions of medial stabilizing rail 1010. Ribbing 1040 may include one or more areas of increased thickness to provide increased stiffness to one or more portions of medial stabilizing rail 1010. In some embodiments, the thickness of ribbing 1040 may vary along the length of medial stabilizing rail 1010 to provide varying degrees of stiffness to one or more portions of medial stabilizing rail 1010. In some embodiments, ribbing 1040 may be disposed on interior surface 1014 of medial stabilizing rail 1010. In some embodiments, ribbing 1040 may alternatively or additionally be disposed on exterior surface 1012 of medial stabilizing rail 1010.

In some embodiments, ribbing 1040 may extend from forefoot end 1022 of medial stabilizing rail 1010 to midfoot portion 1524 of medial stabilizing rail 1010. In some embodiments, ribbing 1040 may extend from forefoot end 1022 of medial stabilizing rail 1010 to heel end 1026 of medial stabilizing rail 1010. The length and position of ribbing(s) 1040 may be tailored to provide desired stiffness characteristics for medial stabilizing rail 1010.

In some embodiments, medial stabilizing rail 1010 may include a medial fin 1028 extending from a top portion 1027 of heel end 1026. Medial fin 1028 may provide support for the medial side of a wearer's ankle. The support provided by medial fin 1028 may help avoid undue twisting of a wearer's ankle. The shape and size of medial fin 1028 may be tailored to provide a desired amount of support and stability for a wearer's ankle. In some embodiments, ribbing 1040 may be disposed on medial fin 1028 to provide desired support and stability.

Added support and stability provided by lateral fin 1068 and/or medial fin 1028 may be desirable for certain types of footwear, such as for example, football cleats or basketball shoes, which are employed in sports that require an athlete to change directions quickly and often and where collisions between athletes are common.

In some embodiments, a bottom portion 1025 of heel end 1026 may include a heel cup 1030. Exterior surface 1012 defining heel cup 1030 may be coupled to a top surface of a midsole (e.g., top surface 132 of midsole 130) when medial stabilizing rail 1010 is coupled to an article of footwear. Heel cup 1030 may have a shape corresponding to the medial shape of a wearer's heel for providing support around the wearer's heel. The support provided by heel cup 1030 may help transfer energy from a wearer's foot to the ground (i.e., help provide propulsion).

In some embodiments, heel ends 1026/1066 of medial stabilizing rail 1010 and lateral stabilizing rail 1050 may different. In such embodiments, heel ends 1026/1066 may be sized and shaped to provide different degrees of support and stability to opposing sides of a wearer's ankle. In some embodiments, the heel ends 1026/1066 of medial stabilizing rail 1010 and lateral stabilizing rail 1050 may be substantially the same.

Figure 13:
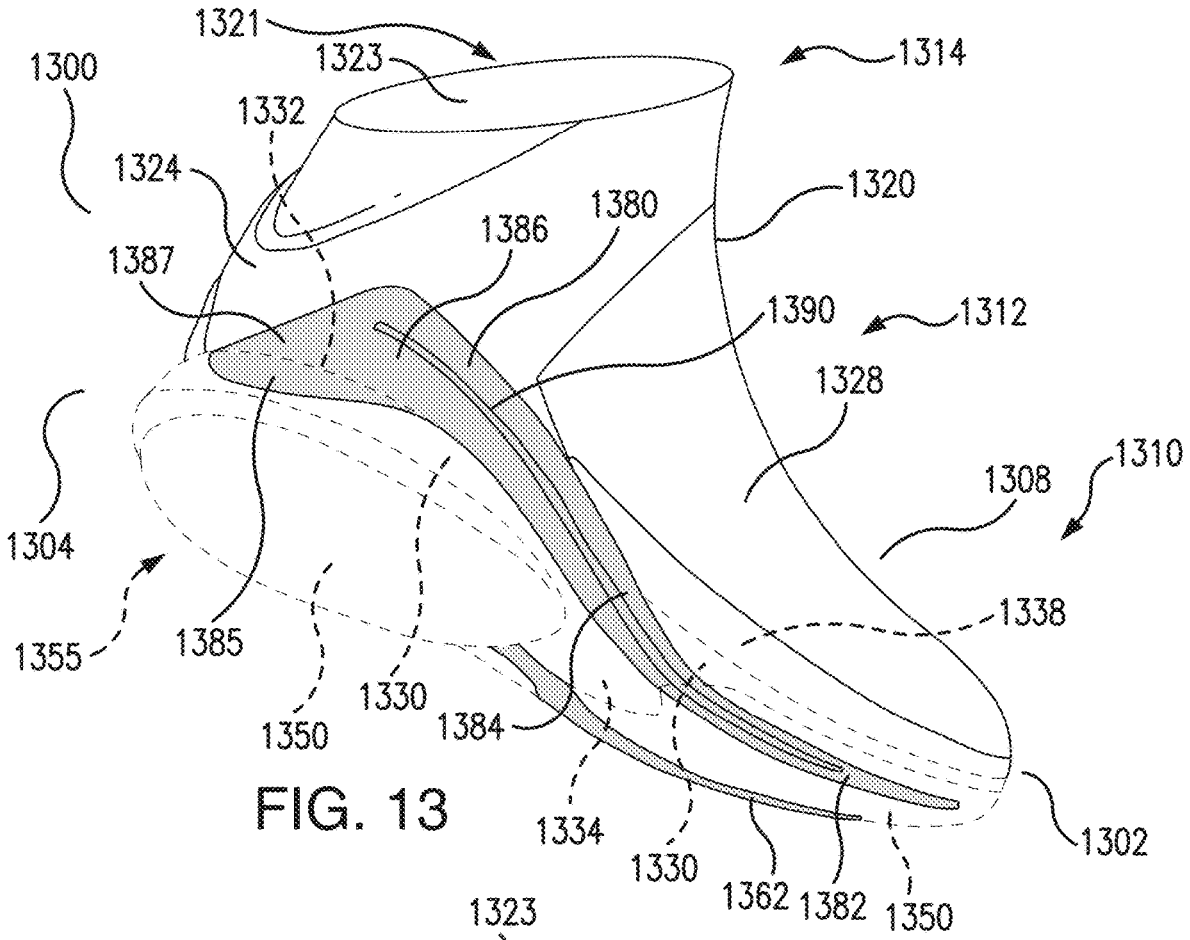
FIG. 13 is a lateral perspective view of an article of footwear according to an embodiment.
Figure 14:
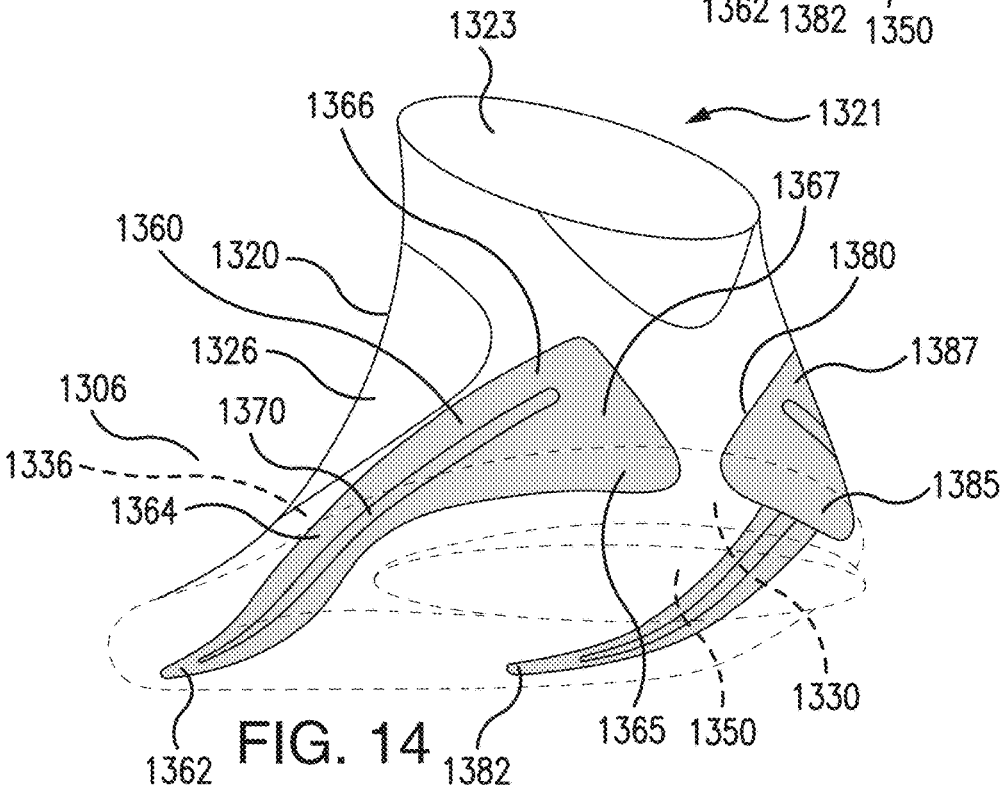
FIG. 14 is a heel end perspective view of an article of footwear according to an embodiment.

FIGS. 13 and 14 show an article of footwear 1300 according to an embodiment. Article of footwear 1300 may include an upper 1320 coupled to a midsole 1330. Upper 1320 includes a hollow interior 1321 for receiving a wearer's foot and defined by an innermost surface 1323 of upper 1320.

Article of footwear 1300 includes a forefoot end 1302, a heel end 1304, a medial side 1306, and a lateral side 1308 opposite medial side 1306. Similar to article of footwear 100, article of footwear 1300 includes a forefoot portion 1310, a midfoot portion 1312, and a heel portion 1314. Portions 1310, 1312, and 1314 are not intended to demarcate precise areas of article of footwear 1300. Rather, portions 1310, 1312, and 1314 are intended to represent general areas of article of footwear 1300 that provide a frame of reference. Although portions 1310, 1312, and 1314 apply generally to article of footwear 1300, references to portions 1310, 1312, and 1314 also may apply specifically to upper 1320 or midsole 1330, or individual components of upper 1320 or midsole 1330. In some embodiments, article of footwear 1300 may include an outsole 1350 coupled to midsole 1330. Together, midsole 1330 and outsole 1350 may define a sole 1355 of article of footwear 1300. Midsole 1330 and outsole 1350 are shown in broken lines in the figures are for illustration purposes.

Article of footwear 1300 may include a lateral stabilizing rail 1380 coupled to upper 1320 and midsole 1330 and extending from forefoot portion 1310 of article of footwear 1300 to heel portion 1314 of article of footwear 1300. Lateral stabilizing rail 1380 may include a forefoot end 1382, a midfoot portion 1384, and a heel end 1386. In some embodiments, forefoot end 1382 may be coupled to a bottom surface 1334 of midsole 1330 in forefoot portion 1310 of midsole 1330. In some embodiments, forefoot end 1382 of lateral stabilizing rail 1380 may extend to a location on article of footwear 1300 below a wearer's posterior phalanges. In some embodiments, outsole 1350 may be disposed over all or a portion of forefoot end 1382 of lateral stabilizing rail 1380.

In some embodiments, heel end 1386 may be coupled to a lateral side 1328 of upper 1320 and wrap around at least a portion of heel end 1324 of upper 1320. In some embodiments, a portion of heel end 1386 may be coupled to a lateral side surface 1338 of midsole 1330 in heel portion 1314 of midsole 1330. Midfoot portion 1384 of lateral stabilizing rail 1380 may be coupled to lateral side surface 1338 of midsole 1330 in midfoot portion 1312 of midsole 1330. Midfoot portion 1384 may include a curved segment that warps around lateral side surface 1338 to bottom surface 1334 of midsole 1330, like midfoot portion 184 of lateral stabilizing rail 180.

Article of footwear 1300 may include a medial stabilizing rail 1360 coupled to upper 1320 and midsole 1330 and extending from forefoot portion 1310 of article of footwear 1300 to heel portion 1314 of article of footwear 1300. Medial stabilizing rail 1360 may include a forefoot end 1362, a midfoot portion 1364, and a heel end 1366. In some embodiments, forefoot end 1362 may be coupled to bottom surface 1334 of midsole 1330 in forefoot portion 1310 of midsole 1330. In some embodiments, forefoot end 1362 of medial stabilizing rail 1360 may extend to a location on article of footwear 1300 below a wearer's posterior phalanges. In some embodiments, outsole 1350 may be disposed over all or a portion of forefoot end 1362 of medial stabilizing rail 1360.

In some embodiments, heel end 1366 may be coupled to a medial side 1326 of upper 1320 and wrap around at least a portion of heel end 1324 of upper 1320. In some embodiments, a portion of heel end 1366 may be coupled to a medial side surface 1336 of midsole 1330 in heel portion 1314 of midsole 1330. Midfoot portion 1364 of medial stabilizing rail 1360 may be coupled to medial side surface 1336 of midsole 1330 in midfoot portion 1312 of midsole 1330. Midfoot portion 1364 may include a curved segment that warps around medial side surface 1336 to bottom surface 1334 of midsole 1330, like midfoot portion 164 of medial stabilizing rail 160.

Similar to lateral stabilizing rail 180 and medial stabilizing rail 160, lateral stabilizing rail 1380 and medial stabilizing rail 1360 are separate pieces. In some embodiments, lateral stabilizing rail 1380 may be a single integrally formed piece (e.g., an injection molded or three-dimensionally printed piece). In some embodiments, medial stabilizing rail 1360 may be single integrally formed piece (e.g., an injection molded or three-dimensionally printed piece). Lateral stabilizing rail 1380 and medial stabilizing rail 1360 may be independent rails.

As shown for example in FIGS. 13 and 14, heel end 1386 of lateral stabilizing rail 1380 may include a bottom portion 1385 coupled to a top surface 1332 of midsole 1330 and a top portion 1387 coupled to heel portion 1314 of upper 1320. In some embodiments, a portion of top portion 1387 may wrap around and be coupled to at least a portion of heel end 1324 of upper 1320. In some embodiments, heel end 1366 of medial stabilizing rail 1360 may include a bottom portion 1365 coupled to top surface 1332 of midsole 1330 and a top portion 1367 coupled to heel portion 1314 of upper 1320. In some embodiments, a portion of top portion 1367 may wrap around and be coupled to at least a portion of heel end 1324 of upper 1320.

In some embodiments, heel end 1386 of lateral stabilizing rail 1380 and heel end 1366 of medial stabilizing rail 1360 may have different shapes. In some embodiments, heel end 1386 of lateral stabilizing rail 1380 and heel end 1366 of medial stabilizing rail 1360 may have substantially the same shape. In some embodiments, lateral stabilizing rail 1380 and medial stabilizing rail 1360 may be substantially mirror images of each other disposed on opposite sides of article of footwear 1300.

In operation, lateral stabilizing rail 1380 and medial stabilizing rail 1360 serve to, among other things, provide stability and propulsion for article of footwear 1300 in the same fashion as described herein for lateral stabilizing rail 180 and medial stabilizing rail 160.

In some embodiments, medial stabilizing rail 1360 may include ribbing 1370 disposed along at least a portion of medial stabilizing rail 1360. Ribbing 1370 may be disposed on an internal surface and/or external surface of medial stabilizing rail 1360. Ribbing 1370 may include one or more areas of increased thickness to provide increased stiffness to one or more portions of medial stabilizing rail 1360. In some embodiments, ribbing 1370 may extend from forefoot portion 1310 of article of footwear 1300 to midfoot portion 1312 of article of footwear 1300. In some embodiments, ribbing 1370 may extend from forefoot portion 1310 of article of footwear 1300 to heel portion 1314 of article of footwear 1300.

In some embodiments, the thickness of ribbing 1370 may vary along the length of medial stabilizing rail 1360 to provide varying degrees of stiffness to different portions of medial stabilizing rail 1360. For example, a portion of ribbing 1370 located in forefoot portion 1310 of article of footwear 1300 may be thicker than a portion of ribbing 1370 located in midfoot portion 1312 and heel portion 1314 of article of footwear 1300. In such embodiments, this increase in stiffness in forefoot portion 1310 may provide increase propulsion characteristics for article of footwear 1300.

In some embodiments, lateral stabilizing rail 1380 may include ribbing 1390 disposed along at least a portion of lateral stabilizing rail 1380. Ribbing 1390 may be disposed on an internal surface and/or external surface of lateral stabilizing rail 1380. Ribbing 1390 may include one or more areas of increased thickness to provide increased stiffness to one or more portions of lateral stabilizing rail 1380.

In some embodiments, ribbing 1390 may extend from forefoot portion 1310 of article of footwear 1300 to midfoot portion 1312 of article of footwear 1300. In some embodiments, ribbing 1390 may extend from forefoot portion 1310 of article of footwear 1300 to heel portion 1314 of article of footwear 1300. In some embodiments, the thickness of ribbing 1390 may vary along the length of lateral stabilizing rail 1380 to provide varying degrees of stiffness to different portions of lateral stabilizing rail 1380.

In some embodiments, ribbing 1370 of medial stabilizing rail 1360 and ribbing 1390 of lateral stabilizing rail 1380 may be different to provide different degrees of stability and/or propulsion to lateral and medial portions of article of footwear 1300. In some embodiments, the thickness of medial stabilizing rail 1360 itself, and portions thereof, may be tailored to provide different degrees of stability and/or propulsion to medial portions of article of footwear 1300. In some embodiments, the thickness of lateral stabilizing rail 1380 itself, and portions thereof, may be tailored to provide different degrees of stability and/or propulsion to lateral portions of article of footwear 1300.

In some embodiments, ribbing 1370 and ribbing 1390 may be the substantially same (i.e., substantially mirror images of each other opposite sides of article of footwear 1300). In some embodiments, ribbing(s) 1370/1390 may serve to provide customized stability and/or propulsion characteristics for an article of footwear.

In some embodiments, as shown for example in FIGS. 13 and 14, the distance between innermost surface 1323 of upper 1320 and lateral stabilizing rail 1380 may decrease from forefoot end 1382 of lateral stabilizing rail 1380 to heel end 1386 of lateral stabilizing rail 1380. Similarly, the distance between innermost surface 1323 and medial stabilizing rail 1360 may decrease from forefoot end 1362 of medial stabilizing rail 1360 to heel end 1366 of medial stabilizing rail 1360. In some embodiments, these decreases in distance may be due at least in part to forefoot ends 1362/1382 being coupled to bottom surface 1334 of midsole 1330 and heel ends 1366/1386 being coupled to top surface 1332 of midsole 1330. In some embodiments, article of footwear 100 may have these same decreases in distance due at least in part to forefoot ends 162/182 of rails 160/180 being coupled to bottom surface 134 of midsole 130 and heel ends 166/186 being coupled to top surface 132 of midsole 130.

Figure 15:
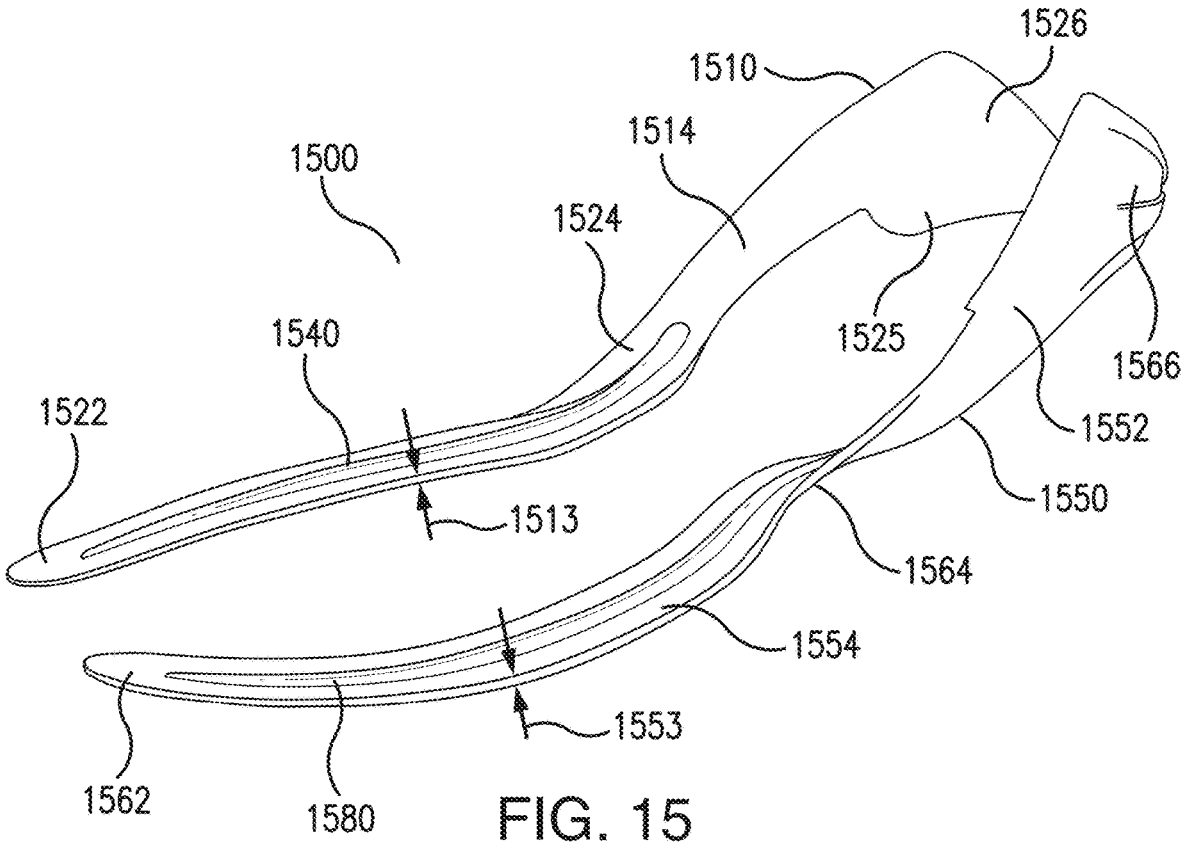
FIG. 15 is a perspective view of a pair of rails according to an embodiment.
Figure 16:
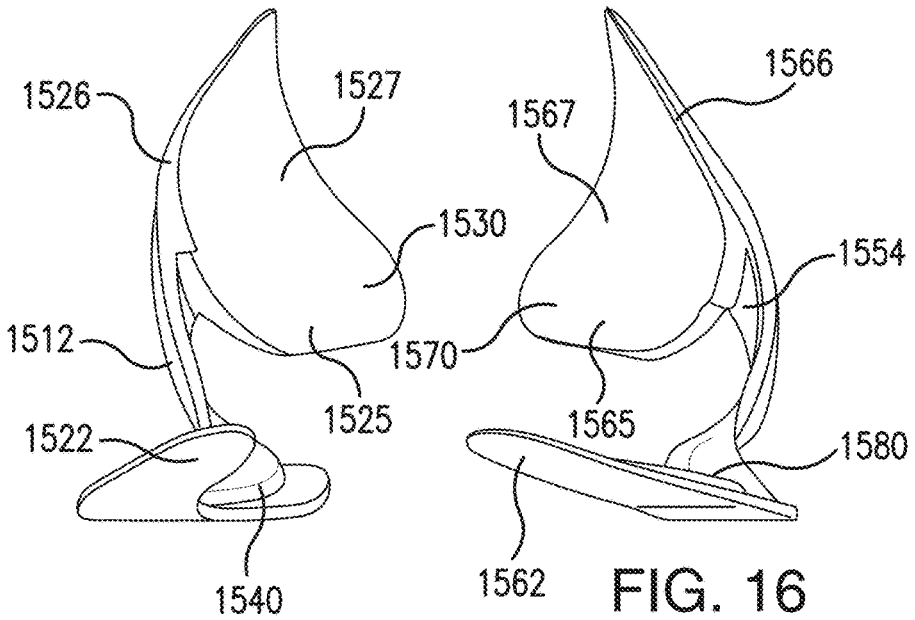
FIG. 16 is a forefoot end view of a pair of rails according to an embodiment.
Figure 17:
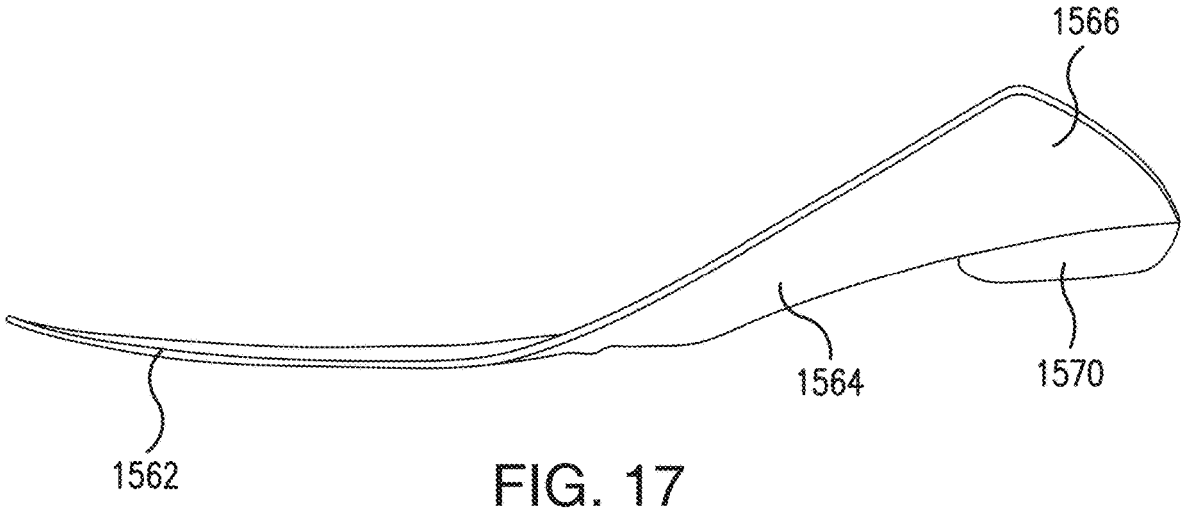
FIG. 17 is a lateral side view of a pair of rails according to an embodiment.

FIGS. 15-17 show a pair of stabilizing rails 1500, lateral stabilizing rail 1550 and medial stabilizing rail 1510, according to an embodiment. Stabilizing rails 1500 may be disposed on an article of footwear, such as, for example, article of footwear 1300 discussed herein.

Lateral stabilizing rail 1550 includes an exterior surface 1552, an interior surface 1554, and a thickness 1553 defined by exterior surface 1552 and interior surface 1554. In some embodiments, thickness 1553 may be in the range of 1.0 mm and 10.0 mm. When coupled to an article of footwear, interior surface 1554 may be coupled to an upper and midsole as discussed, for example, in regards to lateral stabilizing rail 1380 and article of footwear 1300. Lateral stabilizing rail 1550 also includes a forefoot end 1562, a midfoot portion 1564, and a heel end 1566.

In some embodiments, lateral stabilizing rail 1550 may include ribbing 1580 for increasing the stiffness of one or more portions of lateral stabilizing rail 1550. In some embodiments, ribbing 1580 may be disposed on interior surface 1554 of lateral stabilizing rail 1550. In some embodiments, ribbing 1580 may alternatively or additionally be disposed on exterior surface 1552 of lateral stabilizing rail 1550.

In some embodiments, a bottom portion 1065 of heel end 1566 may include a heel cup 1570. Exterior surface 1552 defining heel cup 1570 may be coupled to a top surface of a midsole (e.g., top surface 1332 of midsole 1330) when lateral stabilizing rail 1550 is coupled to an article of footwear. Heel cup 1570 may have a shape corresponding to the lateral shape of a wearer's heel for providing support around the wearer's heel. The support provided by heel cup 1570 may help transfer energy from a wearer's foot to a surface, such as the ground (i.e., help provide propulsion). A top portion 1567 of lateral stabilizing rail 1550 may be configured to wrap around at least a portion of a heel end of an upper for an article of footwear.

Medial stabilizing rail 1510 includes an exterior surface 1512, an interior surface 1514, and a thickness 1513 defined by exterior surface 1512 and interior surface 1514. When coupled to an article of footwear, interior surface 1514 may be coupled to an upper and midsole as discussed, for example, in regards to medial stabilizing rail 1360 and article of footwear 1300. Medial stabilizing rail 1510 also includes a forefoot end 1522, a midfoot portion 1524, and a heel end 1526. In some embodiments, medial stabilizing rail 1510 may include ribbing 1540 for increasing the stiffness of one or more portions of medial stabilizing rail 1510. In some embodiments, ribbing 1540 may be disposed on interior surface 1514 of medial stabilizing rail 1510. In some embodiments, ribbing 1540 may alternatively or additionally be disposed on exterior surface 1512 of medial stabilizing rail 1510.

In some embodiments, a bottom portion 1525 of heel end 1526 may include a heel cup 1530. Exterior surface 1512 defining heel cup 1530 may be coupled to a top surface of a midsole (e.g., top surface 1332 of midsole 1330) when medial stabilizing rail 1510 is coupled to an article of footwear. Heel cup 1530 may have a shape corresponding to the medial shape of a wearer's heel for providing support around the wearer's heel. The support provided by heel cup 1530 may help transfer energy from a wearer's foot to surface, such as the ground (i.e., help provide propulsion). A top portion 1527 of medial stabilizing rail 1510 may be configured to wrap around at least a portion of a heel end of an upper for an article of footwear.

In some embodiments, heel ends 1526/1566 of medial stabilizing rail 1510 and lateral stabilizing rail 1550 may be substantially different. In some embodiments, the heel ends 1526/1566 of medial stabilizing rail 1510 and lateral stabilizing rail 1550 may be substantially the same. In some embodiments, heel ends 1526/1566 may be substantially mirror images of each other.

In some embodiments, heel ends 1526/1566 of medial stabilizing rail 1510 and lateral stabilizing rail 1550 may not include fins. In such embodiments, the weight added to an article of footwear by medial stabilizing rail 1510 and lateral stabilizing rail 1550 may be minimized. The lightweight nature of rails 1510/1550 may be desirable for certain types of footwear, such as for example, track shoes, soccer cleats, or biking shoes, which are employed in sports where lightweight footwear is advantageous.

In some embodiments, a pair of rails (e.g., lateral stabilizing rail 180 and medial stabilizing rail 160) may be customized for an individual. In such embodiments, an individual's gait may be analyzed using, for example, a Vicon® Motion Capture system with force plates.

Based at least in part on the data collected, a pair of rails may be customized to an individual's support, stability, and propulsion needs. In some embodiments, the pair of rails may also be customized based on an individual's athletic needs (e.g., the type of sport the individual plays and/or the amount of time the individual spends exercising). Parameters of a pair of rails that may be customized to an individual's needs include, but are not limited to: a) the shape and size of the fin for the lateral stabilizing rail, b) the shape and size of the fin for the medial stabilizing rail, c) the thickness profile, position, and length of ribbing(s) on the lateral stabilizing rail, d) the thickness profile, position, and length of ribbing(s) on the medial stabilizing rail, e) the material of the lateral stabilizing rail, f) the material of the medial stabilizing rail, g) the thickness profile of the lateral stabilizing rail, h) the thickness profile of the medial stabilizing rail, and i) the absence of any one of: a fin for the lateral stabilizing rail, a fin for the medial stabilizing rail, ribbing for the lateral stabilizing rail, and ribbing for the medial stabilizing rail.

In some embodiments, the characteristics of a midsole (e.g., the material(s) of a midsole) may be customized for an individual based on the data collected and/or based on an individual's athletic needs. For example, a long distance runner may desire a midsole that provides a high degree of cushioning for long distance runs. As another example, a football player may desire a relatively stiff midsole that resists deformation when medial and lateral rails act on the midsole, thereby providing a high degree of support for his or her feet (e.g., a high degree support for his or her ankles).

In some embodiments, one or a pair of rails may be customized or tuned to a particular individual's foot or gait. This customization may be based on unique user characteristics provided by, for example, a pressure map of the user's foot or gait. Characteristics of a user's foot or gait may be determined by a sensor, including, but not limited to, an accelerometer or gyroscope. In some embodiments, one or a pair of rails may be customized for an individual to modify an irregularity in the individual's gait. In such embodiments, one or a pair of rails may provide stability and/or propulsion characteristics to modify the individual's gait (i.e., modify his or her gait to a preferred motion). Correcting/modifying an individual's gait to preferred motion may reduce discomfort for an individual during exercise.

In some embodiments, the rails may be customized to provide a desired aesthetic. For example, the rails may be colored according to a desired aesthetic. In some embodiments, one or more rails may include desired graphics, logos, or other indicia.

In some embodiments, customized rails for an individual may be manufactured using a process including three-dimensional printing of the rails. In some embodiments, customized rails for an individual may be manufactured using a process including injection molding of the rails.

Some embodiments may include an article of footwear including an upper coupled to a midsole; a lateral stabilizing rail coupled to the upper and the midsole and extending from a forefoot portion of the article of footwear to a heel portion of the article of footwear, the lateral stabilizing rail including a forefoot end coupled to a bottom surface of the midsole and a heel end coupled to and wrapping around at least a portion of a heel end of the upper; a medial stabilizing rail coupled to the upper and the midsole and extending from the forefoot portion of the article of footwear to the heel portion of the article of footwear, the medial stabilizing rail including a forefoot end coupled to the bottom surface of the midsole and a heel end coupled to and wrapping around at least a portion of the heel end of the upper; where the lateral stabilizing rail and the medial stabilizing rail are separate pieces and the lateral stabilizing rail is a single integrally formed piece and the medial stabilizing rail is a single integrally formed piece.

In any of the various embodiments discussed herein, a lateral stabilizing rail and a medial stabilizing rail may be independent rails. In any of the various embodiments discussed herein, a lateral stabilizing rail and a medial stabilizing rail may not be attached to each other.

In any of the various embodiments discussed herein, a heel end of a lateral stabilizing rail may include a bottom portion coupled to a top surface of a midsole and a top portion coupled to a heel portion of an upper and a heel end of a medial stabilizing rail may include a bottom portion coupled to the top surface of the midsole and a top portion coupled to the heel portion of the upper.

In any of the various embodiments discussed herein, an article of footwear of may include an outsole coupled to a midsole and disposed over the forefoot end of a lateral stabilizing rail and the forefoot end of a medial stabilizing rail.

In any of the various embodiments discussed herein, a lateral stabilizing rail and a medial stabilizing rail may be composed of a material having a higher stiffness than the material of a midsole.

In any of the various embodiments discussed herein, a medial stabilizing rail may include ribbing disposed along at least a portion of the medial stabilizing rail, and the ribbing of the medial stabilizing rail may include one or more areas of increased thickness to provide increased stiffness. In any of the various embodiments discussed herein, ribbing of a medial stabilizing rail may extend from the forefoot portion of an article of footwear to a midfoot portion of the article of footwear.

In any of the various embodiments discussed herein, a lateral stabilizing rail may include ribbing disposed along at least a portion of the lateral stabilizing rail and the ribbing of the lateral stabilizing rail may include one or more areas of increased thickness to provide increased stiffness. In any of the various embodiments discussed herein, ribbing of a lateral stabilizing rail may extend from the forefoot portion of an article of footwear to a midfoot portion of the article of footwear.

In any of the various embodiments discussed herein, an midsole may include a lateral groove formed in a lateral side surface and a bottom surface of the midsole and a medial groove formed in a medial side surface and the bottom surface of the midsole, and a lateral stabilizing rail may be partially disposed in the lateral groove and a medial stabilizing rail may be partially disposed in the medial groove.

In any of the various embodiments discussed herein, an upper may include a hollow interior for receiving a wearer's foot, the hollow interior defined by an innermost surface of the upper, the distance between the innermost surface and a lateral stabilizing rail may decrease from the forefoot end of the lateral stabilizing rail to the heel end of the lateral stabilizing rail, and the distance between the innermost surface and a medial stabilizing rail may decrease from the forefoot end of the medial stabilizing rail to the heel end of the medial stabilizing rail.

In any of the various embodiments discussed herein, a heel end of a lateral stabilizing rail may include a bottom portion coupled to a top surface of a midsole and a top portion coupled to a heel portion of an upper and extending towards the forefoot portion of an article of footwear, and a heel end of a medial stabilizing rail may include a bottom portion coupled to the top surface of the midsole and a top portion coupled to the heel portion of the upper and wrapping around at least a portion of the heel end of the upper.

In any of the various embodiments discussed herein, a portion of a top portion of a lateral stabilizing rail and a portion of a top portion of a medial stabilizing rail may extend in the same direction around the perimeter of an upper.

In any of the various embodiments discussed herein, a heel end of a lateral stabilizing rail and a heel end of a medial stabilizing rail mat have different shapes. In any of the various embodiments discussed herein, a heel end of a lateral stabilizing rail and a heel end of a medial stabilizing rail may have substantially the same shape. In any of the various embodiments discussed herein, a lateral stabilizing rail and a medial stabilizing rail may be substantially mirror images of each other.

Some embodiments may include an article of footwear including an upper coupled to a midsole; a lateral stabilizing rail coupled to the upper and the midsole and extending from a forefoot portion of the article of footwear to a heel portion of the article of footwear, the lateral stabilizing rail including a forefoot end coupled to the midsole, a heel end coupled to and wrapping around at least a portion of a heel end of the upper, and a lateral fin extending from the heel end of the lateral stabilizing rail; and a medial stabilizing rail coupled to the upper and the midsole and extending from the forefoot portion of the article of footwear to the heel portion of the article of footwear, the medial stabilizing rail including a forefoot end coupled to the midsole, a heel end coupled to and wrapping around at least a portion of the heel end of the upper, and a medial fin extending from the heel end of the medial stabilizing rail; where the lateral fin and the medial fin extend in the same direction around the perimeter of the upper.

In any of the various embodiments discussed herein, a lateral fin may extend towards the forefoot portion of an article of footwear and a medial fin may extend towards and wrap around at least a portion of the heel end of an upper.

Some embodiments may include an article of footwear including an upper coupled to a midsole; a lateral stabilizing rail coupled to the upper and the midsole and extending from a forefoot portion of the article of footwear to a heel portion of the article of footwear, the lateral stabilizing rail including a forefoot end coupled to a bottom surface of the midsole and a heel end coupled to and wrapping around at least a portion of a heel end of the upper; and a medial stabilizing rail coupled to the upper and the midsole and extending from the forefoot portion of the article of footwear to the heel portion of the article of footwear, the medial stabilizing rail including a forefoot end coupled to the bottom surface of the midsole and a heel end coupled to and wrapping around at least a portion of the heel end of the upper; where the heel end of the lateral stabilizing rail includes a bottom portion coupled to a top surface of the midsole and a top portion coupled to a heel portion of the upper and the heel end of the medial stabilizing rail includes a bottom portion coupled to the top surface of the midsole and a top portion coupled to the heel portion of the upper.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. An article of footwear comprising:

an upper coupled to a midsole;

a lateral stabilizing rail coupled to the upper and the midsole and extending from a forefoot portion of the article of footwear to a heel portion of the article of footwear, the lateral stabilizing rail comprising a forefoot end coupled to a bottom surface of the midsole and a heel end coupled to and wrapping around at least a portion of a heel end of the upper;

a medial stabilizing rail coupled to the upper and the midsole and extending from the forefoot portion of the article of footwear to the heel portion of the article of footwear, the medial stabilizing rail comprising a forefoot end coupled to the bottom surface of the midsole and a heel end coupled to and wrapping around at least a portion of the heel end of the upper; and an outsole coupled to the midsole and disposed over the forefoot end of the lateral stabilizing rail and the forefoot end of the medial stabilizing rail;

wherein at least one of the medial stabilizing rail and the lateral stabilizing rail comprises:

ribbing disposed along at least a portion of the rail disposed between the bottom surface of the midsole and the outsole, wherein the portion of the rail disposed between the bottom surface of the midsole and the outsole comprises a thickness measured between an interior surface and an exterior surface of the rail and the ribbing comprises one or more areas of increased thickness disposed between the bottom surface of the midsole and the outsole to provide increased stiffness, wherein the lateral stabilizing rail and the medial stabilizing rail are separate pieces, and wherein the lateral stabilizing rail is a single integrally formed piece and the medial stabilizing rail is a single integrally formed piece.

2. The article of footwear of claim 1, wherein the lateral stabilizing rail and the medial stabilizing rail are independent rails.

3. The article of footwear of claim 1, wherein the heel end of the lateral stabilizing rail comprises a bottom portion coupled to a top surface of the midsole and a top portion coupled to a heel portion of the upper, and wherein the heel end of the medial stabilizing rail comprises a bottom portion coupled to the top surface of the midsole and a top portion coupled to the heel portion of the upper.

4. The article of footwear of claim 1, wherein the lateral stabilizing rail and the medial stabilizing rail are composed of a material having a higher stiffness than the material of the midsole.

5. The article of footwear of claim 1, wherein the medial stabilizing rail comprises the ribbing and the ribbing extends from the forefoot portion of the article of footwear to a midfoot portion of the article of footwear.

6. The article of footwear of claim 1, wherein the lateral stabilizing rail comprises the ribbing and the ribbing extends from the forefoot portion of the article of footwear to a midfoot portion of the article of footwear.

7. The article of footwear of claim 1, wherein the midsole comprises a lateral groove formed in a lateral side surface and the bottom surface of the midsole and a medial groove formed in a medial side surface and the bottom surface of the midsole, and wherein the lateral stabilizing rail is partially disposed in the lateral groove and the medial stabilizing rail is partially disposed in the medial groove.

8. The article of footwear of claim 1, wherein the upper comprises a hollow interior for receiving a wearer's foot, the hollow interior defined by an innermost surface of the upper, wherein the distance between the innermost surface and the lateral stabilizing rail decreases from the forefoot end of the lateral stabilizing rail to the heel end of the lateral stabilizing rail, and wherein the distance between the innermost surface and the medial stabilizing rail decreases from the forefoot end of the medial stabilizing rail to the heel end of the medial stabilizing rail.

9. The article of footwear of claim 1, wherein the heel end of the lateral stabilizing rail comprises a bottom portion coupled to a top surface of the midsole and a top portion coupled to a heel portion of the upper and extending towards the forefoot portion of the article of footwear, and wherein the heel end of the medial stabilizing rail comprises a bottom portion coupled to the top surface of the midsole and a top portion coupled to the heel portion of the upper and wrapped around at least a portion of the heel end of the upper.

10. The article of footwear of claim 3, wherein a portion of the top portion of the lateral stabilizing rail and a portion of the top portion of the medial stabilizing rail extend in the same direction around the perimeter of the upper.

11. The article of footwear of claim 1, wherein the heel end of the lateral stabilizing rail and the heel end of the medial stabilizing rail have different shapes.

12. The article of footwear of claim 1, wherein the heel end of the lateral stabilizing rail and the heel end of the medial stabilizing rail have substantially the same shape.

13. The article of footwear of claim 1, wherein the lateral stabilizing rail and the medial stabilizing rail are substantially mirror images of each other.

14. An article of footwear comprising:

an upper coupled to a midsole;

a lateral stabilizing rail coupled to the upper and the midsole and extending from a forefoot portion of the article of footwear to a heel portion of the article of footwear, the lateral stabilizing rail comprising a forefoot end coupled to the midsole, a heel end coupled to and wrapping around at least a portion of a heel end of the upper, and a lateral fin extending from the heel end of the lateral stabilizing rail; and a medial stabilizing rail coupled to the upper and the midsole and extending from the forefoot portion of the article of footwear to the heel portion of the article of footwear, the medial stabilizing rail comprising a forefoot end coupled to the midsole, a heel end coupled to and wrapping around at least a portion of the heel end of the upper, and a medial fin extending from the heel end of the medial stabilizing rail;

wherein the lateral fin and the medial fin extend in the same direction around the perimeter of the upper, wherein the lateral fin extends towards the forefoot portion of the article of footwear and the medial fin extends towards and wraps around at least a portion of the heel end of the upper such that a highest point of the medial fin is disposed on the heel end of the upper and a highest point of the lateral fin is disposed closer to a toe end of the upper than the highest point of the medial fin.

15. An article of footwear comprising:

an upper coupled to a midsole, the upper comprising a hollow interior for receiving a wearer's foot, the hollow interior defined by an innermost surface of the upper;

a lateral stabilizing rail coupled to the upper and the midsole and extending from a forefoot portion of the article of footwear to a heel portion of the article of footwear, the lateral stabilizing rail comprising a forefoot end coupled to a bottom surface of the midsole, a heel end coupled to and wrapping around at least a portion of a heel end of the upper, and a midfoot portion comprising a curved segment that wraps around a lateral side of the midsole such that the distance between the innermost surface of the upper and the lateral stabilizing rail decreases from the forefoot end of the lateral stabilizing rail to the heel end of the lateral stabilizing rail; and a medial stabilizing rail coupled to the upper and the midsole and extending from the forefoot portion of the article of footwear to the heel portion of the article of footwear, the medial stabilizing rail comprising a forefoot end coupled to the bottom surface of the midsole, a heel end coupled to and wrapping around at least a portion of the heel end of the upper, and a midfoot portion comprising a curved segment that wraps around a medial side of the midsole such that the distance between the innermost surface of the upper and the medial stabilizing rail decreases from the forefoot end of the medial stabilizing rail to the heel end of the medial stabilizing rail;

wherein the lateral stabilizing rail and the medial stabilizing rail are independent rails, wherein the heel end of the lateral stabilizing rail comprises a bottom portion coupled to a top surface of the midsole and a top portion coupled to a heel portion of the upper, and wherein the heel end of the medial stabilizing rail comprises a bottom portion coupled to the top surface of the midsole and a top portion coupled to the heel portion of the upper.

16. The article of footwear of claim 14, wherein the heel end of the lateral stabilizing rail comprises a V-shape defined in part by the lateral fin, and wherein the V-shape opens towards the forefoot portion of the article of footwear.

17. The article of footwear of claim 14, wherein the heel end of the medial stabilizing rail comprises a V-shape defined in part by the medial fin, and wherein the V-shape open towards and wraps around at least a portion of the heel end of the upper.

18. The article of footwear of claim 1, wherein the midsole comprises a groove formed in the bottom surface of the midsole, wherein the groove comprises a slot, and wherein the ribbing is disposed within the slot.

* * * * *